US006789472B2

(12) United States Patent
Nakamura et al.

(10) Patent No.: US 6,789,472 B2
(45) Date of Patent: Sep. 14, 2004

(54) STENCIL PRINTING MACHINE

(75) Inventors: Akira Nakamura, Ibaraki-ken (JP); Taku Naitou, Ibaraki-ken (JP); Takuya Shibahara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/677,379

(22) Filed: Oct. 3, 2003

(65) Prior Publication Data

US 2004/0069164 A1 Apr. 15, 2004

(30) Foreign Application Priority Data

| | | |
|---|---|---|
| Oct. 7, 2002 | (JP) | P2002-293497 |
| Jul. 22, 2003 | (JP) | P2003-277242 |
| Sep. 16, 2003 | (JP) | P2003-322419 |

(51) Int. Cl.[7] ..... B41L 13/04; B41L 13/18

(52) U.S. Cl. ..... 101/119; 101/116

(58) Field of Search ..... 101/116, 119, 101/120

(56) References Cited

U.S. PATENT DOCUMENTS

| | | | | | |
|---|---|---|---|---|---|
| 3,949,666 | A | * | 4/1976 | Zimmer | 101/119 |
| 4,085,672 | A | * | 4/1978 | Grosart | 101/169 |
| 5,443,557 | A | * | 8/1995 | Hasegawa | 101/119 |
| 6,382,097 | B2 | * | 5/2002 | Watanabe et al. | 101/129 |

FOREIGN PATENT DOCUMENTS

| | | |
|---|---|---|
| DE | 164 375 | 8/1904 |
| JP | 07-132675 | 5/1995 |
| JP | 2001-246828 | 9/2001 |

* cited by examiner

*Primary Examiner*—Andrew H. Hirshfeld
*Assistant Examiner*—Jill E. Culler
(74) *Attorney, Agent, or Firm*—Nath & Associates PLLC; Marvin C. Berkowitz

(57) ABSTRACT

A stencil printing machine includes a drum which is rotatable and has an outer peripheral wall formed by an ink impermeable member and in which a stencil sheet is mounted on a surface of the outer peripheral wall. An ink supply device has an ink supply unit at a printing position upstream of a maximum printing area of the outer peripheral wall of the drum and supplies ink on the surface of the outer peripheral wall from the ink supply unit. A pressure roller presses a fed print medium onto the outer peripheral wall.

20 Claims, 35 Drawing Sheets

STENCIL PRINTING MACHINE

BACKGROUND OF THE INVENTION

1. Field of the Invention

The present invention relates to a stencil printing machine which conveys a print medium while pressing the print medium to a drum on which a stencil sheet is mounted, and transfers ink oozing from perforations of the stencil sheet onto the print medium.

2. Description of Related Art

Printing method of a conventional stencil printing machine include an inner press printing method (refer to Japanese Patent Laid-Open Publication No. 7-132675) and an outer press printing method (refer to Japanese Patent Laid-Open Publication No. 2001-246828).

Brief description of the inner press printing method is as follows. As shown in FIG. 1, the conventional stencil printing machine with the inner press printing method has a drum 100 and a paper cylinder 101, which are rotatably provided and placed so that the outer peripheral surfaces thereof are partially close to each other. The outer peripheral surface of the drum 100 is provided with a sheet clamping portion 100*a* which clamps an end of a stencil sheet 104, and the outer peripheral wall thereof apart form the sheet clamping portion 100*a* is flexible and formed by an ink permeable screen 102.

An ink supply mechanism 105 is provided inside the drum 100. As shown in FIG. 2, this ink supply mechanism 105 has an inner press roller 106 which is an ink supply roller and is rotatably provided in a roller support member 107. The inner press roller 106 is constructed to be movable between a press position and a holding position. At the press position, a force is applied to the roller support member 107 in a direction shown by an arrow a in FIG. 2 so that the inner press roller 106 presses the inner peripheral surface of a screen 102. At the holding position, the roller support member 107 is rotated in a direction shown by an arrow b in FIG. 2 so that the inner press roller 106 is spaced apart from the inner peripheral surface of the screen 102. The inner press roller 106 is located in the press position while print paper 111 passes and comes to the holding position during the rest of the time. The inner press roller 106 also has a function to allow printing pressure to act on the inner peripheral surface of the screen 102.

Further, the roller support member 107 is rotatably supported about a support axis 108 serving as a center and provided with a doctor roller 109 and a driving rod 110. The doctor roller 109 is cylindrical and fixed by the roller support member 107 in the vicinity of the inner press roller 106. The driving rod 110 is rotatably supported by the roller support member 107 and placed in an upper space formed by the outer peripheral surfaces of the inner press roller 106 and the doctor roller 109 on the sides close each other. Ink 103 is supplied to this upper space from an unillustrated ink supply unit.

Next, the outline of a printing operation will be sequentially described. The stencil sheet 104 with a perforation image formed therein is mounted on the outer peripheral surface of the screen 102. Then, in a printing mode, the drum 100 and the paper cylinder 101 are rotated in synchronization with each other in a direction shown by an arrow in FIG. 1. Thereafter, the print paper 111 is fed between the drum 100 and the paper cylinder 101.

Once the print paper 111 is fed, the inner press roller 106 presses the screen 102 and rotates following the drum 100 while pressing the screen 102. The ink 103 that has passed through the gap between the doctor roller 109 and the inner press roller 106 is applied on the outer peripheral surface of the inner press roller 106, and the applied ink 103 is sequentially supplied onto the inner surface of the screen 102 by the rotation of the inner press roller 106.

Further, when the inner press roller 106 presses the screen 102, the screen 102 stretches out toward the outer periphery thereof by the pressure and comes into contact with the paper cylinder 101 under the pressure. Then, the print paper 111 that has been conveyed between the drum 100 and the paper cylinder 101 is conveyed between the inner press roller 106 and the paper cylinder 101 while being in contact with and pressed by the screen 102 and the stencil sheet 104. Due to this contact and pressure force, the ink 103 on the screen 102 is transferred onto the print paper 111 from the perforations of the stencil sheet 104, and thereby an ink image is printed on the print paper 111.

Brief description of the outer press printing method is as follows. As shown in FIG. 3, the conventional stencil printing machine with the outer press printing method has a drum 120. On the outer peripheral surface of the drum 120, a stencil sheet clamping portion 120*a* which clamps an end of the stencil sheet 104 is provided, and the outer peripheral wall 120*b* of the drum 120 apart from the stencil sheet clamping portion 120*a* is formed by a perforated ink penetratable member (ink permeable member).

An ink supply mechanism 125 is provided inside the drum 120. This ink supply system 125 has a rotatably supported squeegee roller 126 and a doctor roller 127 placed adjacent to this squeegee roller 126. Ink 128 is stored in an outer peripheral space surrounded by the squeegee roller 126 and the doctor roller 127. The ink 128 applied on the outer periphery of the rotating squeegee roller 126 passes through a gap between the squeegee roller 126 and the doctor roller 127. Thus, only the ink 128 with a predetermined thickness is applied on the squeegee roller 126, and the ink 128 having this predetermined thickness is supplied on the inner surface of the outer peripheral wall 120*b* of the drum 120.

Further, a pressure roller 130 is provided at a position facing the squeegee roller 126 and outside the drum 120. The pressure roller 130 is constructed to be able to move between a press position where the pressure roller 130 presses the outer peripheral wall 120*b* of the drum 120 and a holding position where the pressure roller 130 is spaced apart from the outer peripheral wall 120*b* of the drum 120. The pressure roller 130 comes to the press position while the print paper 111 passes and to the holding position during the rest of the time. The squeegee roller 126 is secured to a support portion which rotatably supports the outer peripheral wall 120*b* of the drum 120. There is a clearance between the outer peripheral surface of the squeegee roller 126 and the inner peripheral surface of the outer peripheral wall 120*b* of the drum 120 in the state where the drum 120 is not pressed by the pressure roller 130. When the outer peripheral wall 120*b* of the drum 120 is pressed by the pressure roller 130, the outer peripheral wall 120*b* of the drum 120 bends so that the inner peripheral surface of the outer peripheral wall 120*b* of the drum 120 comes into contact with the outer peripheral surface of the squeegee roller 126.

Next, the outline of a printing operation of the outer press printing method will be sequentially described. The stencil sheet 104 with a perforation image formed therein is mounted on the outer peripheral surface of the outer peripheral wall 120*b* of the drum. Then, in a printing mode, the outer peripheral wall 120*b* of the drum 120 is rotated in a direction shown by an arrow in FIG. 3, and the print paper 111 is fed between the drum 120 and the pressure roller 130.

Once the print paper 111 is fed, the pressure roller 130 presses the outer peripheral wall 120*b* of the drum 120, and the outer peripheral wall 120*b* is bent toward the inner periphery thereof. Due to this displacement, the outer peripheral wall 120*b* presses the squeegee roller 126, and the squeegee roller 126 rotates following the drum 120. The ink 128 that has passed through the gap between the doctor roller 127 and the squeegee roller 126 is applied on the outer peripheral surface of the squeegee roller 126, and this applied ink 128 is sequentially supplied onto the inner surface of the outer peripheral wall 120*b* by the rotation of the squeegee roller 126.

Further, when the pressure roller 130 presses the outer peripheral wall 120*b* of the drum 120, the print paper 111 which has been conveyed between the drum 120 and the pressure roller 130 is conveyed between the squeegee roller 126 and the pressure roller 130 while being in contact with and pressed by the stencil sheet 104. Due to this contact and pressure force, the ink 128 on the outer peripheral wall 120*b* is transferred onto the print paper 111 from the perforations of the stencil sheet 104, and thereby an ink image is printed on the print paper 111.

SUMMARY OF THE INVENTION

However, in the conventional stencil printing machines with the inner press printing method and the outer press printing method, ink pools are formed in the outer peripheral space between the inner press roller 106 and the doctor roller 109 and the outer peripheral space between the squeegee roller 126 and the doctor roller 127, respectively. Then, the ink 103 and the ink 128 of these ink pools are supplied to the screen 102 of the drum 100 and to the outer peripheral wall 120*b* of the drum 120, respectively. Therefore, when printing is not carried out for a long time, there has been a problem that the ink 103 and 128 stored in the ink pools are left contacting with the atmosphere for a long time, resulting in deterioration of the ink 103 and 128.

Further, since various rollers and the like for ink supply have to be arranged within the drums 100 and 120, there has been a problem that it is difficult to realize the small and lightweight drums 100 and 120.

The present invention was accomplished to resolve the above-mentioned problems, and an object of the present invention is to provide a stencil printing machine in which ink does not deteriorate even when printing is not carried out for a long time, and a small and lightweight drum can be realized.

The stencil printing machine according to the present invention has a drum, an ink supply device, and a pressure roller. The drum is rotatable and has a outer peripheral wall formed by an ink impermeable member. On the outer peripheral wall of the roller, a stencil sheet is mounted. The ink supply device has an ink supply unit at a printing position upstream of a maximum printing area of the outer peripheral wall of the drum and supplies ink on the surface on the outer peripheral wall from this ink supply unit. The pressure roller presses a fed print medium onto the outer peripheral wall.

In this stencil printing machine, when the print medium is fed while the outer peripheral wall of the drum is rotated and ink is supplied on the surface of the outer peripheral wall from the ink supply unit, the print medium is conveyed while being pressed by the pressure roller onto the stencil sheet and the outer peripheral wall of the drum. Meanwhile, the ink between the outer peripheral wall of the drum and the stencil sheet is diffused downstream of a printing direction while being squeezed by the pressing force of the pressure roller. At the same time, the diffused ink oozes from perforations of the stencil sheet and is transferred on the print medium, thus an ink image is printed on the print medium. The ink supplied on the drum is held in an approximately sealed space between the outer peripheral wall of the drum and the stencil sheet. Therefore, contact with the atmosphere is minimized, and it is not required to arrange various rollers for ink supply within the drum.

In a preferred example, ink leakage preventing grooves are provided on the outer peripheral wall at the positions outside the maximum printing area and covered by the stencil sheet. In this stencil printing machine, when the ink between the outer peripheral wall and the stencil sheet leaks outside of the maximum printing area, the leaking ink goes into the ink leakage preventing grooves.

The ink leakage preventing grooves are respectively provided at the right and left positions outside the maximum printing area in a printing perpendicular direction. In this stencil printing machine, the ink leaking from the maximum printing area of the outer peripheral wall in the printing perpendicular direction goes into the ink leakage preventing grooves.

The ink leakage preventing groove may be provided at a printing position downstream of the maximum printing area. In this stencil printing machine, the ink leaking in a printing direction downstream of the maximum printing area of the outer peripheral wall goes into the ink leakage preventing groove.

The ink leakage prevention groove may be provided on right and left outsides of the maximum printing area in a printing perpendicular direction and on a printing position downstream of the maximum printing area. In this stencil printing machine, the ink leaking from the maximum printing area of the outer peripheral wall in the printing perpendicular direction and the ink leaking in a printing direction downstream of the maximum printing area of the outer peripheral wall goes into the ink leakage preventing grooves.

The ink leakage preventing groove may be provided at a printing position further upstream of the ink supply unit upstream of the maximum printing area. In this stencil printing machine, the ink leaking in a printing direction upstream of the ink supply unit of the outer peripheral wall goes into the ink leakage preventing groove.

A plurality of the ink leakage preventing grooves may be provided. In this stencil printing machine, when the ink overflows from the ink leakage preventing groove on the inner peripheral side, the overflowing ink goes into the ink leakage preventing groove on the outer peripheral side. Further, in the case of forming the plurality of ink leakage preventing grooves whose total volume is the same as that of one ink leakage preventing groove, each of the ink leakage preventing grooves is formed to have a narrow width.

An Ink recovery device may be provided for recovering the ink flown outside the maximum printing area of the outer peripheral wall. In this stencil printing machine, the excessive ink is removed from the outer peripheral wall and recycling of the ink is achieved.

The ink recovery device may have an ink recovery groove at a printing position downstream of the maximum printing area of the outer peripheral wall and recover the ink stored in the ink recovery groove. In this stencil printing machine, the ink flown out on the downstream side of printing by being squeezed by the pressure roller is removed from the outer peripheral wall, and recycling of the ink can be realized.

In the ink recovery groove, a depression preventing member can be placed through which the ink can pass. In this stencil printing machine, the stencil sheet is not depressed into the ink recovery groove. Moreover, the stencil sheet does not stick to an edge of the ink recovery groove and thus does not seal the ink at the sticking position. Therefore, the ink smoothly flows into the ink recovery groove by being squeezed by the pressure roller. Furthermore, the stencil sheet is not depressed into the ink recovery groove when the pressure roller passes over the ink recovery groove.

The depression preventing member may be flush with the peripheral surface of the outer peripheral wall. In this stencil printing machine, the pressure roller moves over an approximately single circumference.

The ink recovery device may recover the ink stored in the ink leakage preventing groove by utilizing the ink leakage preventing groove as the ink recovery groove. In this stencil printing machine, the ink stored in the ink leakage preventing groove is certainly removed.

The ink supply unit may be provided along the printing perpendicular direction on the outer peripheral wall and supplies the ink almost uniformly in the printing perpendicular direction. In this stencil printing machine, the ink is diffused without unevenness in the printing perpendicular direction when the ink is diffused downstream in the printing direction by the pressing force of the pressure roller.

The ink supply unit may supply the ink from a plurality of ink supply ports provided at an interval in the perpendicular direction of printing on the outer peripheral wall. In this stencil printing machine, the stencil sheet is not depressed into the ink supply ports when the pressure roller passes over the ink supply ports.

The stencil printing machine may include ink volume adjusting means which controls a supply volume of the ink from the ink supply unit in the printing perpendicular direction, and control the ink volume adjusting means depending on a perforation percentage of the stencil sheet.

In this stencil printing machine, an ink supply volume is increased in an area with a high perforation percentage and decreased in an area with a low perforation percentage. Thus, only a required volume of ink is supplied in a required area.

The stencil printing machine may include the ink volume adjusting means which controls an ink supply volume from the ink supply unit in the printing perpendicular direction and control the ink volume adjusting means depending on a size of the print medium to be fed.

In this stencil printing machine, the ink is supplied to the area here the print medium is present, and the ink is not supplied to the are a where the print medium is not present. Thus, the ink can be supplied only to the required area.

The ink supply device and the ink recovery device may be always driven in the printing mode. In this stencil printing machine, in the printing mode, the ink is continuously supplied to the outer peripheral wall from the ink supply unit, and the ink that has flown into the ink leakage preventing groove from the outer peripheral wall is always recovered. Additionally, an adequate amount of ink is always held on the outer peripheral wall.

A width of the pressure roller may be set to a width between the ink leakage preventing grooves, respectively provided at the right and left positions in the printing perpendicular direction so that the pressure roller presses the inner sides of the respective outer edges of these two ink leakage preventing grooves. In this stencil printing machine, the pressure roller does not seal the ink leakage preventing grooves while pressing these grooves. In the case where the ink recovery device is constructed to recover the ink in the ink leakage preventing grooves by suction power, the pressure roller does not press the outer sides of the ink leakage preventing grooves.

In addition, in this description, the printing position upstream of the maximum printing area of the outer peripheral wall of the drum means the upstream area of the maximum printing area in the ink flowing direction on the outer peripheral wall of the drum at printing, and the printing downstream area means the downstream area of the maximum printing area in the ink flowing direction on the outer peripheral wall of the drum at printing.

BRIEF DESCRIPTION OF THE DRAWINGS

FIG. 36A is a cross-sectional view of the vicinity of the ink leakage preventing groove, FIG. 36B is a plan view partially showing the vicinity of the ink leakage preventing groove, and 36C is a cross-sectional view explaining behavior of a stencil sheet.

FIG. 37A is a cross-sectional view of the vicinity of the ink leakage preventing groove, and FIG. 37B is a plan view partially showing the vicinity of the ink leakage preventing groove.

DETAILED DESCRIPTION OF THE PREFERRED EMBODIMENTS

Embodiments of the present invention will be described hereinbelow based on the drawings.

Figure 1:
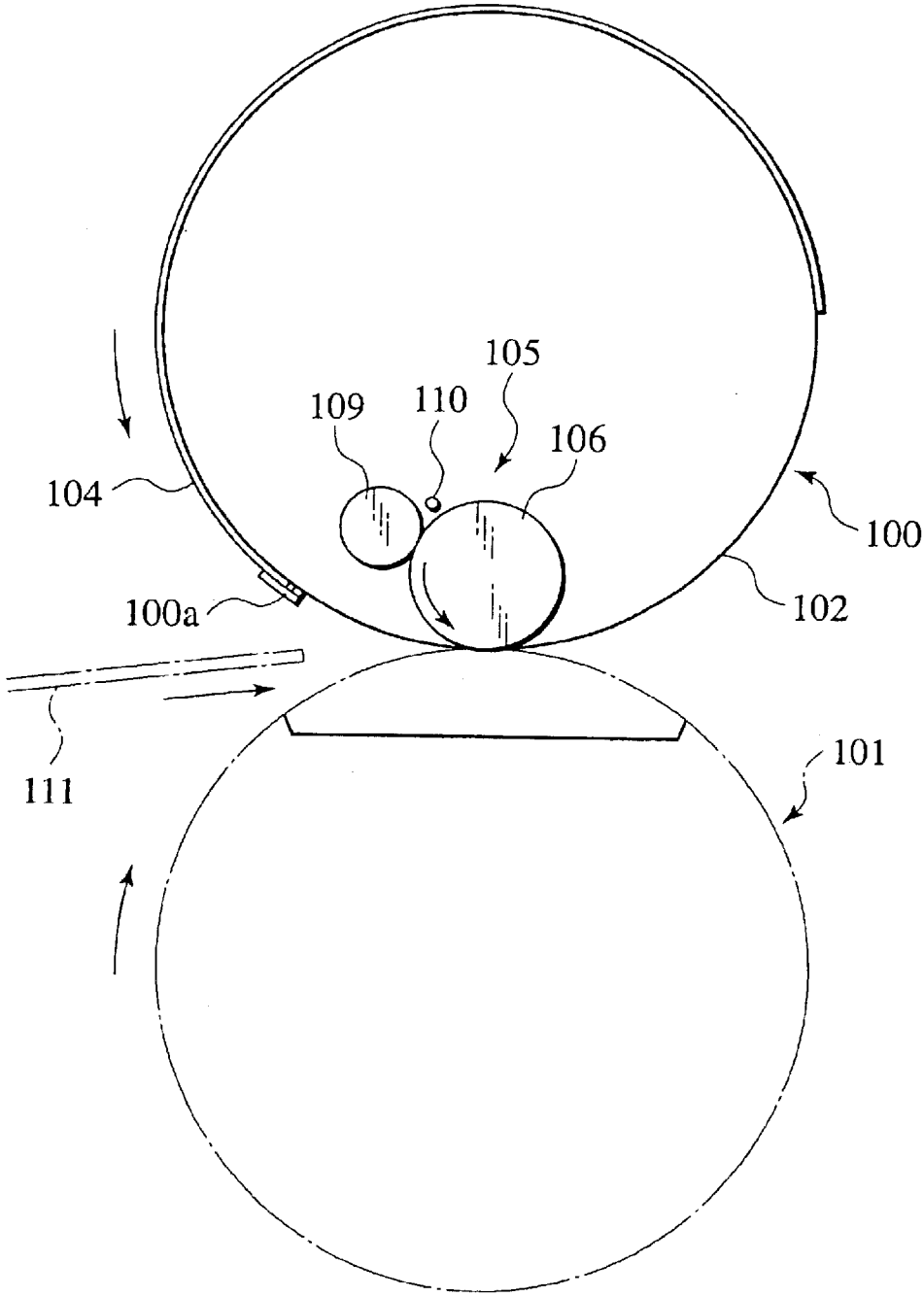
FIG. 1 PRIOR ART
FIG. 1 is a schematic view of a main part of printing of an inner press printing method of a conventional example.
Figure 2:
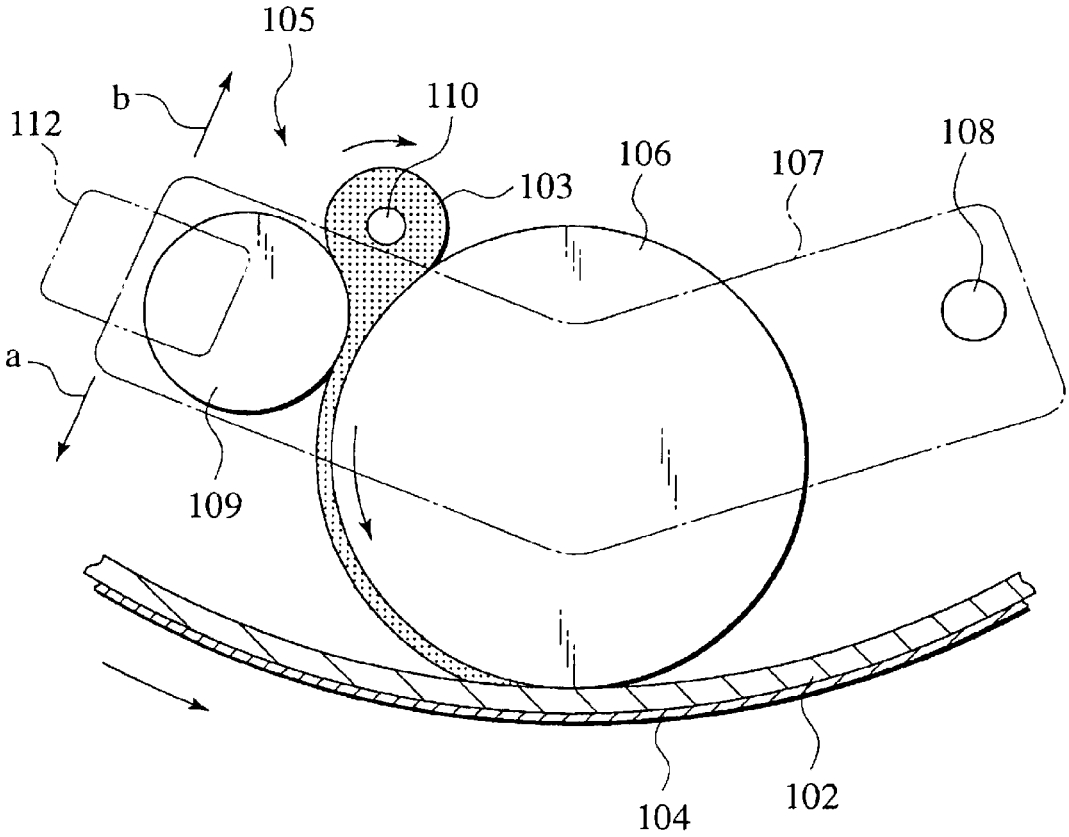
FIG.2 PRIOR ART
FIG. 2 is a schematic view of an ink supply device of the inner press printing method of the conventional example.
Figure 3:
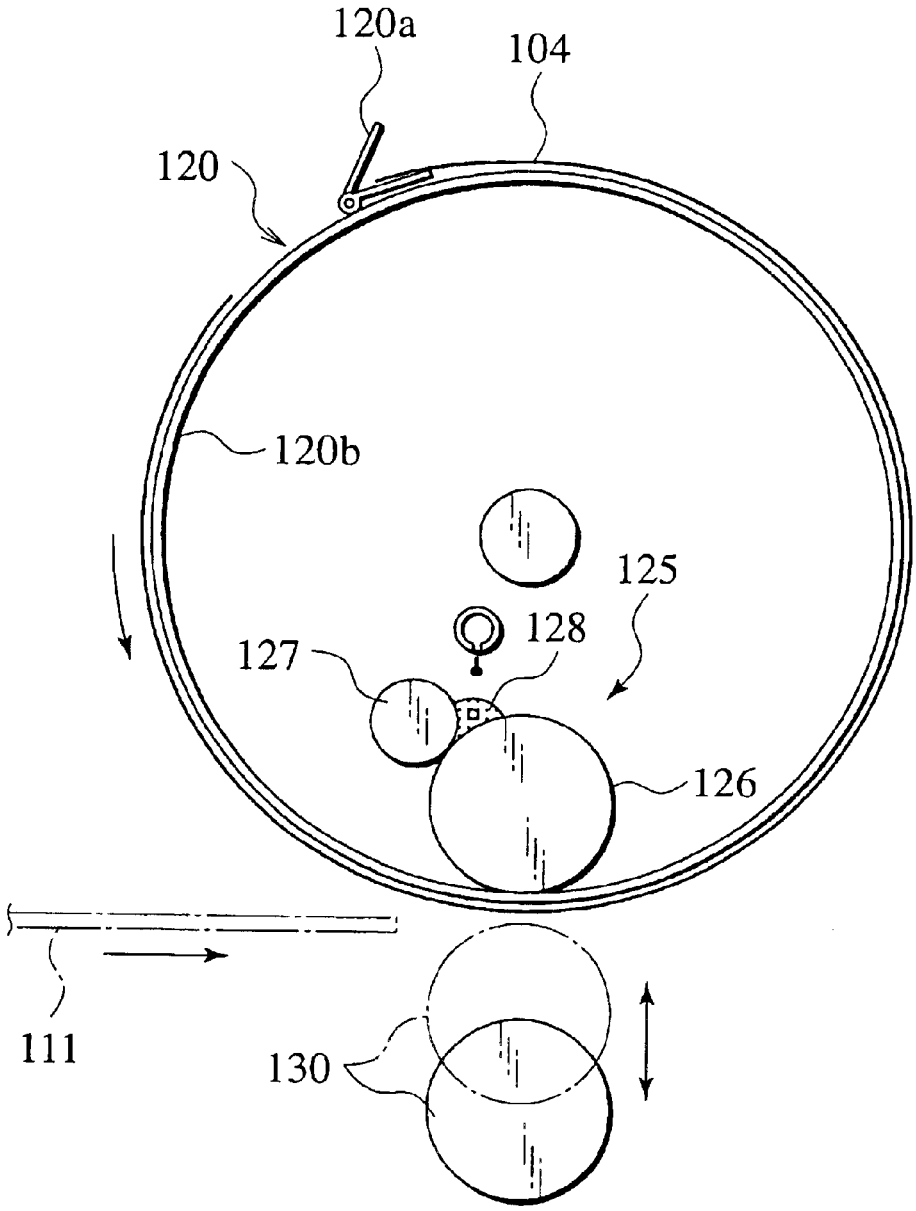
FIG.3 PRIOR ART
FIG. 3 is a schematic view of a main part of printing of an outer press printing method of a conventional example.
Figure 4:
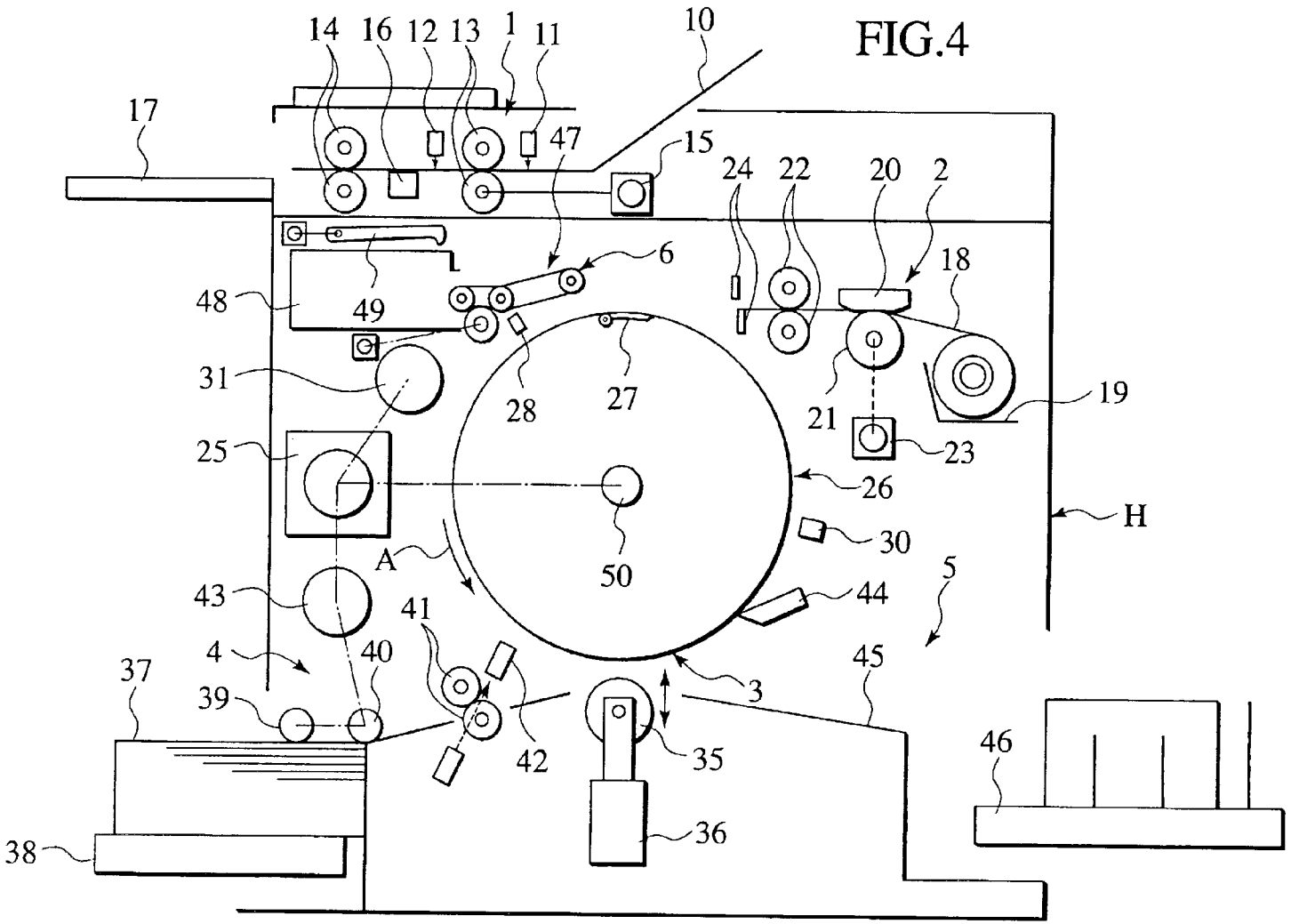
FIG. 4 shows a first embodiment of the present invention and is a schematic view of a stencil printing machine.

As shown if FIG. 4, the stencil printing machine is mainly constructed by an original reading unit 1, a stencil making unit 2, a printing unit 3, a paper feed unit 4, a paper delivery unit 5 and a stencil disposal unit 6.

The original reading unit 1 includes an original setting tray 10 on which the originals to be printed are stacked, reflective-type original sensors 11 and 12 which senses presence of the originals on the original setting tray 10, original conveyer rollers 13 and 14 which convey the original on the original setting tray 10, a stepping motor 15 which drives and rotates the original conveyer rollers 13 and 14, a contact image sensor 16 which optically reads out image data of the original conveyed by the original conveyer rollers 13 and 14 and converts the data into electrical signals, and an original discharging tray 17 on which the originals discharged from the original setting tray 10 are stacked. The original stacked on the original setting tray 10 is conveyed by the original conveyer rollers 13 and 14, and the image sensor 16 reads out the image data of the conveyed originals.

The stencil making unit 2 has a stencil sheet housing 19 which houses a long and rolled stencil sheet 18, a thermal print head 20 placed downstream of this stencil sheet housing 19 in a conveying direction, a platen roller 21 placed at a position opposite to the thermal print head 20, and a pair of stencil sheet transfer rollers 22 and 22 placed downstream of the platen roller 21 and the thermal print head 20 in the conveying direction, a write pulse motor 23 which drives and rotates the platen roller 21 and the stencil sheet transfer rollers 22, and a stencil sheet cutter 24 placed downstream of the pair of stencil sheet transfer rollers 22 and 22 in the conveying direction.

The long stencil sheet 18 is conveyed by the rotation of the platen roller 21 and the stencil sheet transfer rollers 22. Based on the image data read out by the image sensor 16, each of dot-shaped heating elements of the thermal print head 20 selectively performs heating operations, and thereby the stencil sheet 18 is perforated due to thermal sensitivity thereof to make a stencil. Then, the stencil sheet 18 thus made is cut by the stencil sheet cutter 24 to make the stencil sheet 18 with a predetermined length.

The printing unit 3 has a drum 26 which rotates in a direction of an arrow A of FIG. 4 by driving force of a main motor 25, a stencil sheet clamping portion 27 which is provided on the outer peripheral surface of the drum 26 and clamps an end of the stencil sheet 18, a stencil sheet confirming sensor 28 which senses whether or not the stencil sheet 18 is wound and mounted on the outer peripheral surface of the drum 26, a datum position detecting sensor 30 which detects the datum position of the drum 26, and a rotary encoder 31 which detects rotation of the main motor 25. Based on detection output of the datum position detecting sensor 30, an outputted pulse by the rotary encoder 31 is detected, thus enabling the rotation position of the drum 26 to be detected.

In addition, the printing unit 3 has a pressure roller 35 positioned below the drum 26. This pressure roller 35 is constructed to be movable between a press position where the pressure roller 35 presses the outer peripheral surface of the drum 26 by driving force of a solenoid device 36, and a holding position where the pressure roller 35 is spaced apart from the outer peripheral surface of the drum 26. The pressure roller 35 is always placed at the press position during a printing mode period (including trial print) and placed at the holding position during a period other than the printing mode.

Thereafter, the end of the stencil sheet 18 conveyed from the stencil making unit 2 is clamped by the stencil sheet clamping portion 27, and the drum 26 is rotated while the stencil sheet 18 is clamped so that the stencil sheet 18 is wound and mounted on the outer peripheral surface of the drum 26. Then, print paper (print medium) 37, which is fed by the paper feed unit 4 in synchronization with the rotation of the drum 26, is pressed onto the stencil sheet 18 wound and mounted on the outer peripheral surface of the drum 26 by the pressure roller 35. Therefore, ink 56 is transferred from perforations of the stencil sheet 18 onto the print paper 37, and an image is printed.

The paper feed unit 4 has a paper feed tray 38 on which the print paper 37 is stacked, first paper feed rollers 39 and 40 which convey only the print paper 37 at the uppermost position from this paper feed tray 38, and a pair of second paper feed rollers 41 and 41 which convey the print paper 37, which has been conveyed by the first paper feed rollers 39 and 40, between the drum 26 and the pressure roller 35 in synchronization with the rotation of the drum 26, and a paper feed sensor 42 which senses whether or not the print paper 37 is conveyed between the pair of second paper feed rollers 41 and 41. The first paper feed rollers 39 and 40 are constructed so that the rotation of the main motor 25 is selectively transferred thereto through a paper feed clutch 43.

The paper delivery unit 5 has a paper removal claw 44 which removes the printed print paper 37 from the drum 26, a conveying passage 45 through which the print paper 37 removed from the drum 26 by the paper removal claw 44 is conveyed, and a paper receiving tray 46 on which the print paper 37 delivered from the conveying passage 45 is stacked.

The stencil disposal unit 6 has disposed stencil conveying means 47, a stencil disposal box 48 and a disposed stencil compression member 49. The disposed stencil conveying means 47 guides the end of the used stencil sheet 18 unclamped from the outer peripheral surface of the drum 26 and conveys the used stencil sheet 18 that has been guided while peeling it off from the drum 26. The stencil disposal box 48 houses the stencil sheet 18 conveyed by the disposed stencil conveying means 47. The disposed stencil compression member 49 pushes the stencil sheet 18, which has been conveyed by the disposed stencil conveying means 47 into the stencil disposal box 48, into the bottom of the stencil disposal box 48.

Figure 5:
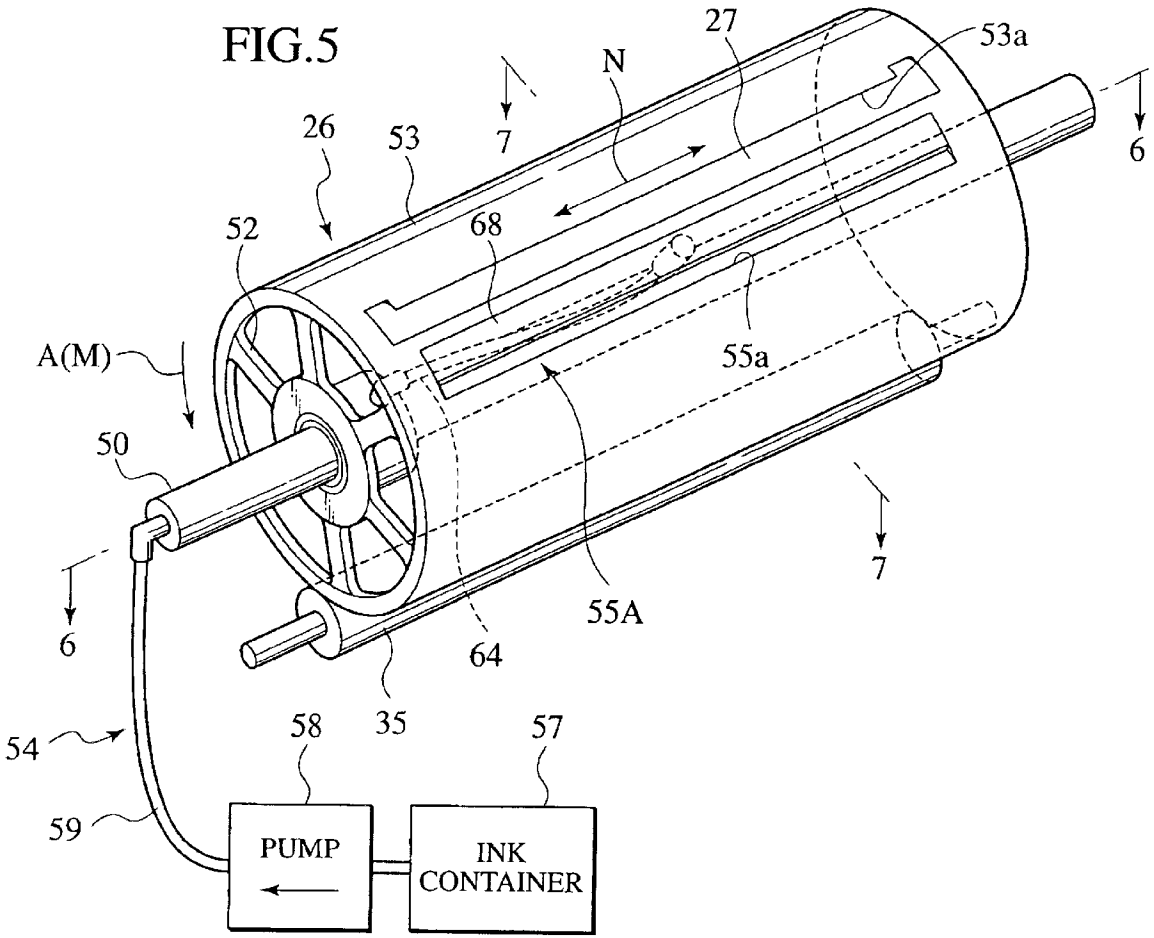
FIG. 5 shows the first embodiment of the present invention and is a perspective view of a drum.
Figure 6:
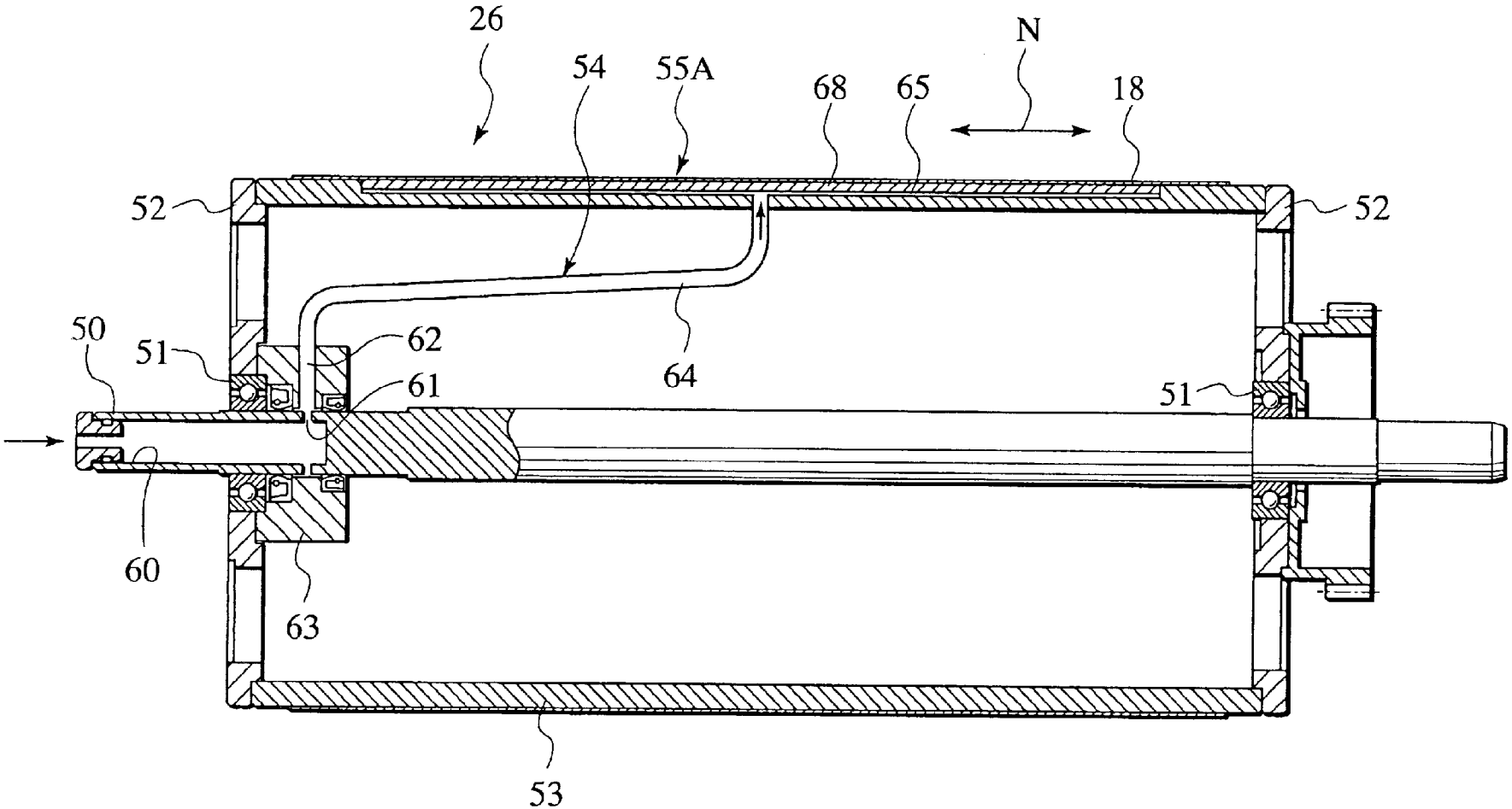
FIG. 6 shows the first embodiment of the present invention and is a cross-sectional view taken along the line 6—6 in FIG. 5.
Figure 7:
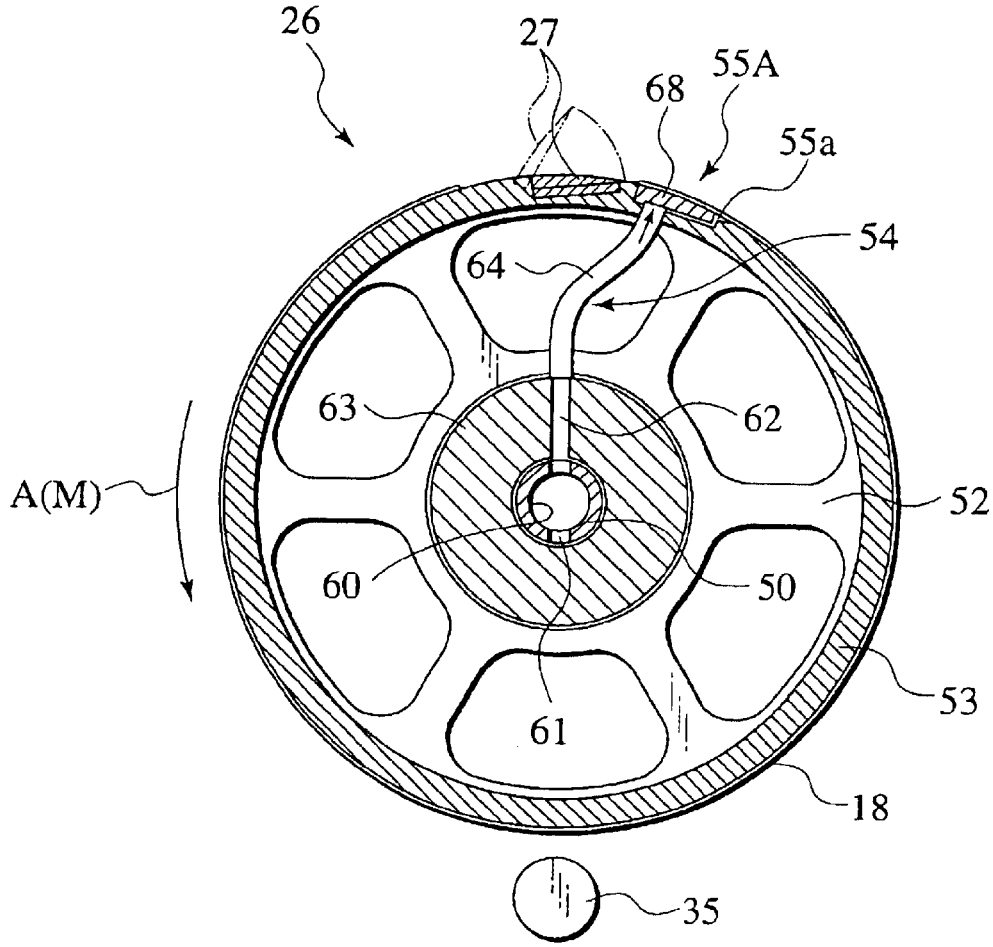
FIG. 7 shows the first embodiment of the present invention and is a cross-sectional view taken along the line 7—7 in FIG. 5.

As shown in FIGS. 5 to 7, the drum 26 has a support axis 50 fixed to the machine body H (shown in FIG. 4), a pair of side disks 52 and 52 rotatably supported by the support axis 50 through each of bearings 51, and a cylindrical outer peripheral wall 53 fixed between the pair of side disks 52 and 52. The outer peripheral wall 53 is driven and rotated by rotation force of the main motor 25 together with the pair of side disks 52 and 52. The outer peripheral wall 53 is also rigid so as not to deform by the pressure of the pressure roller 35 and formed by an ink impermeable member which does not allow the ink 56 to permeate therethrough. Furthermore, the outer peripheral surface of the outer peripheral wall 53 is processed with fluorine contained resin coating process such as Teflon (registered trademark) coating process and formed to have an even cylindrical surface.

The stencil sheet clamping portion 27 is provided by utilizing a concave portion for clamping 53*a* formed along an axis direction of the support axis 50 on the outer peripheral wall 53. One end of the stencil sheet clamping portion 27 is rotatably supported by the outer peripheral wall 53. The clamping portion 27 is provided so as to protrude from the outer peripheral wall 53 in an unclamping state as shown by a virtual line in FIG. 7 and so as not to protrude from the outer peripheral wall 53 in a clamping state shown by a solid line in FIG. 7. Therefore, the stencil sheet clamping portion 27 is capable of clamping the stencil sheet 18 without protruding from the outer peripheral wall 53.

The outer peripheral wall 53 is rotated in a direction of an arrow A of FIGS. 5 and 7, and a starting point of printing thereon is set to a position near the stencil sheet clamping portion 27, which is found after a small rotation of the outer peripheral wall 53. Hence, the rotating direction A equals to a printing direction M, and the area below the starting point of printing is set as a printing area. In this first embodiment, a maximum printing area is set to a region in which A3 size print paper can be printed. In addition, an ink supply unit 55A of an ink supply device 54 is provided at an upstream position of the maximum printing area of the outer peripheral wall 53 in the printing direction M.

As shown in FIGS. 5 to 9, the ink supply device 54 includes an ink container 57 in which the ink 56 is stored, an inking pump 58 which suctions the ink 56 within the ink container 57, a first pipe 59 which supplies the ink 56 suctioned by the inking pump 58, the support axis 50 to which the other end of the first pipe 59 is connected and in which an ink passage 60 is formed and a hole 61 is formed at a position 180 degrees opposite thereto, a rotary joint 63 which is rotatably supported on the outer peripheral side of the support axis 50 and in which a through hole 62 that communicates with the hole 61 is formed, a second pipe 64 in which one end thereof is connected to the rotary joint 63 and the other end thereof is connected to the outer peripheral wall 53, and the ink supply unit 55A to which the other end of the second pipe 64 is opened. The first pipe 59, the support axis 50 and the second axis 64 and the like constitute a conduit for supplying ink between the surface of the outer peripheral wall 53 of the drum 26 and the stencil sheet 18 without expose ink to the atmosphere.

The ink supply unit 55A includes an ink diffusion groove 65 which diffuses the ink 56 from the second pipe 64 in a printing perpendicular direction N, a plurality of through holes 66 which are opened at an interval in the ink diffusion groove 65 in the printing perpendicular direction N, and an ink supply port 55*a* which communicates with the plurality of through holes 66 and is opened to the surface of the outer peripheral wall 53. The ink supply unit 55A is covered and closed up by the stencil sheet 18 for supplying ink between the surface of the outer peripheral wall 53 of the drum 26 and the stencil sheet 18 without expose ink to the atmosphere.

Figure 8:
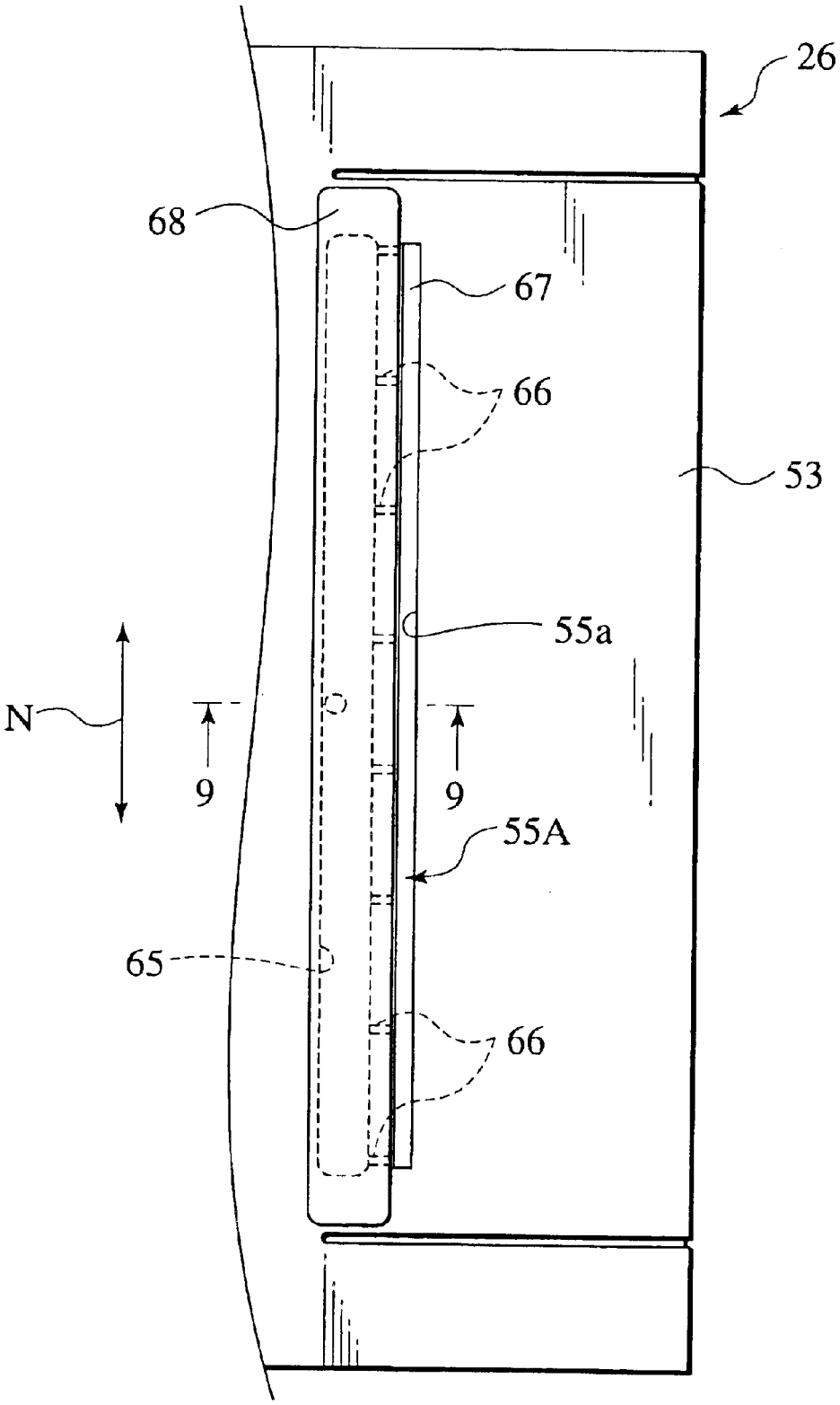
FIG. 8 shows the first embodiment of the present invention and is a plan view of the drum showing an ink supply unit.
Figure 9:
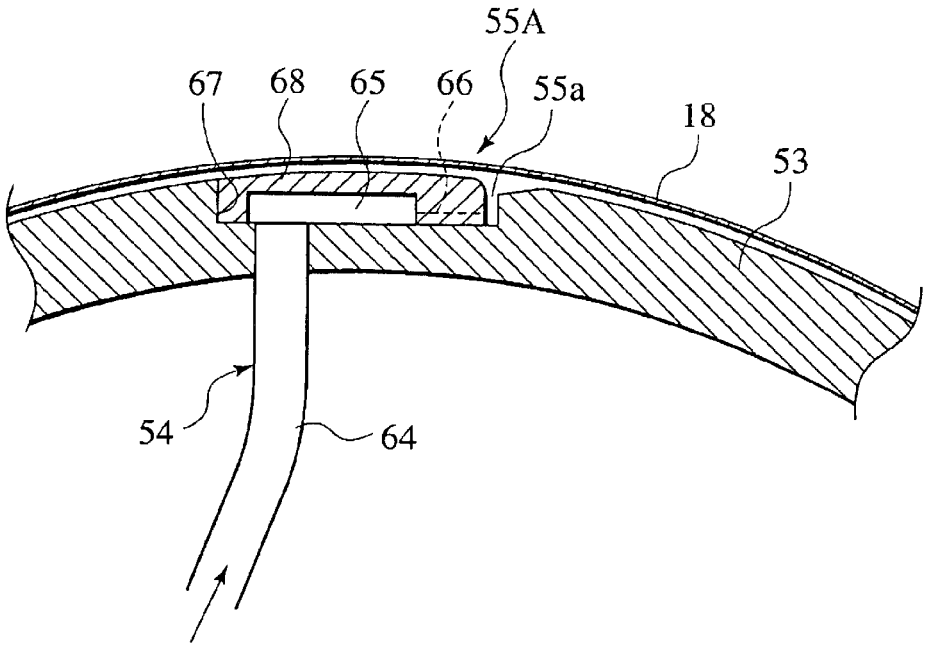
FIG. 9 shows the first embodiment of the present invention and is a cross-sectional view taken along the line 9—9 in FIG. 8.

As shown in FIGS. 8 and 9, the ink diffusion groove 65 and the plurality of through holes 66 as well as the ink supply port 55*a* are formed by a concave portion for ink supply 67 and an ink distribution member 68. The concave portion for ink supply 67 is formed along a perpendicular direction to the printing direction M (i.e., the printing perpendicular direction N) on the outer peripheral wall 53, and the ink distribution member 68 is formed inside of the concave portion 67. The ink supply port 55*a* is formed along the printing perpendicular direction N and supplies the ink 56 almost uniformly in the printing perpendicular direction N on the outer peripheral wall 53.

Next, an operation of the stencil printing machine with the above-mentioned structure will be briefly described.

First of all, when a stencil making mode is selected, in the stencil making unit 2, the stencil sheet 18 is conveyed by rotation of the platen roller 21 and the stencil sheet transfer rollers 22. Then, based on image data read out by the original reading unit 1, the multiple heating elements of the thermal printing head 20 selectively perform heating operations, and thereby the stencil sheet 18 is perforated due to its thermal sensitivity to make the stencil. The stencil sheet 18 thus made is cut at predetermined positions, and thus the stencil sheet 18 with a predetermined dimension is made.

In the printing unit 3, an end of the stencil sheet 18 made in the stencil making unit 2 is clamped by the stencil sheet clamping portion 27 of the drum 26, and the drum 26 is rotated while clamping the stencil sheet 18. The stencil sheet 18 is then wound and mounted on the outer peripheral surface of the drum 26.

Next, when the printing mode is selected, in the printing unit 3, the drum 26 is driven and rotated, and the ink supply device 54 starts driving. Then, the ink 56 is supplied to the outer peripheral wall 53 from the ink supply port 55*a*. Thereafter, the supplied ink 56 is held between the outer peripheral wall 53 and the stencil sheet 18, and the pressure roller 35 is moved from the holding position to the press position.

In the paper feed unit 4, the print paper 37 is fed between the drum 26 and the pressure roller 35 in synchronization with the rotation of the drum 26. The fed print paper 37 is pressed by the pressure roller 35 onto the outer peripheral wall 53 of the drum 26 and conveyed by the rotation of the outer peripheral wall 53 of the drum 26, that is, the print paper 37 is conveyed while closely contacting the stencil sheet 18.

Figure 10:
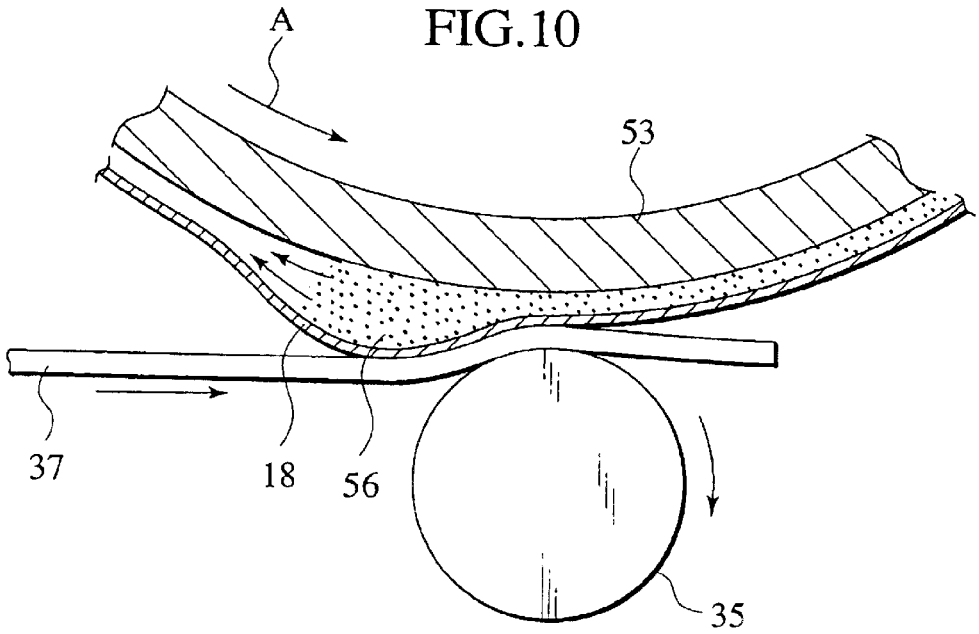
FIG. 10 shows the first embodiment of the present invention and is a partial cross-sectional view explaining an ink diffusion mechanism.

Further, as shown in FIG. 10, as the print paper 37 is conveyed, the ink 56 held between the outer peripheral wall 53 of the drum 26 and the stencil sheet 18 is simultaneously diffused downstream in the printing direction M while being squeezed by the pressure of the pressure roller 35. Then, the diffused ink 56 oozes from perforations of the stencil sheet 18 and is transferred on the print paper 37. Accordingly, an ink image is printed on the print paper 37 in a process of passing between the outer peripheral wall 53 of the drum 26 and the pressure roller 35. The end of the print paper 37 which has passed between the outer peripheral wall 53 of the drum 26 and the pressure roller 35 is peeled off from the drum 26 by the paper removal claw 44 at its end, and the print paper 37 removed from the drum 26 is delivered to the paper receiving tray 46 through-the conveying passage 45 and stacked thereon.

Once printing of a set quantity of the printing paper is completed, the rotation of the outer peripheral wall 53 of the drum 26 is stopped and the ink supply device 54 stops driving. Consequently, supply of the ink 56 to the outer peripheral wall 53 is stopped. The pressure roller 35 is returned back to the holding position from the press position and goes into a holding mode.

When a stencil disposal mode is selected for starting new stencil making or the like, the stencil sheet clamping position 27 of the drum 26 is moved to an unclamping position, and the end of the unclamped stencil sheet 18 is guided by the disposed stencil conveying means 47 as the drum 26 rotates and then housed in the stencil disposal box 48.

As described so far, in this stencil printing machine, the ink 56 is supplied to the outer peripheral wall 53 of the drum 26 and diffused on the outer peripheral wall 53 by being squeezed by pressure force of the pressure roller 35, and the diffused ink 56 is transferred onto the print paper 37 from the perforations of the stencil sheet 18 by the pressure force of the pressure roller 35. Therefore, when the printing mode is finished, the ink 56 supplied to the drum 26 is held in an approximately sealed space between the outer peripheral wall 53 of the drum 26 and the stencil sheet 18, thus contact with the atmosphere is minimized. Accordingly, the ink 56 does not deteriorate even when printing is not carried out for a long time, and the deterioration of the ink 56 can be certainly prevented. Moreover, it is not required to place various rollers for supplying ink within the drum 26 like the conventional examples. Therefore, the drum 26 can be made even smaller and light-weighted.

Moreover, since the outer peripheral wall 53 of the drum 26 is formed by the ink impermeable member, a materials therefor can be selected from a wider range of varieties. In addition, since the structure is simple, the drum 26 can be manufactured at low cost. Furthermore, since strength of the drum 26 is easily increased, a non-uniform image due to fluctuations of the printing pressure can be prevented.

Moreover, since the ink 56 is basically prevented from contacting the atmosphere to a minimum, the ink 56 is used for printing in the best condition with almost no deterioration. Furthermore, since no cares are required for preventing deterioration of the ink 56, there is a higher degree of flexibility in selecting the ink 56.

In this first embodiment, the ink supply unit 55A includes ink supply port 55*a* formed continuously along the printing perpendicular direction N and supplies the ink 56 through the ink supply port 55*a* almost uniformly in the printing perpendicular direction N. Accordingly, the ink 56 can be diffused in the printing perpendicular direction N without unevenness when the ink 56 is diffused downstream in the printing direction M while being squeezed by the pressure of the pressure roller 35. Thus, non-uniform density in printing perpendicular direction N can be certainly prevented.

In the first embodiment, since the stencil sheet clamping portion. 27 does not protrude from the surface of the outer peripheral wall 53 of the drum 26, driving of the pressure roller 35 is easy. This means that it is not required to move the pressure roller 35 between the press position and the holding position for every rotation of the drum 26 in order for the pressure roller 35 to avoid coming into collision with the stencil sheet clamping portion 27. In virtue of this, deficiencies such as noise from the pressure roller 35 and image deterioration due to rebounding can be eliminated.

Figure 11:
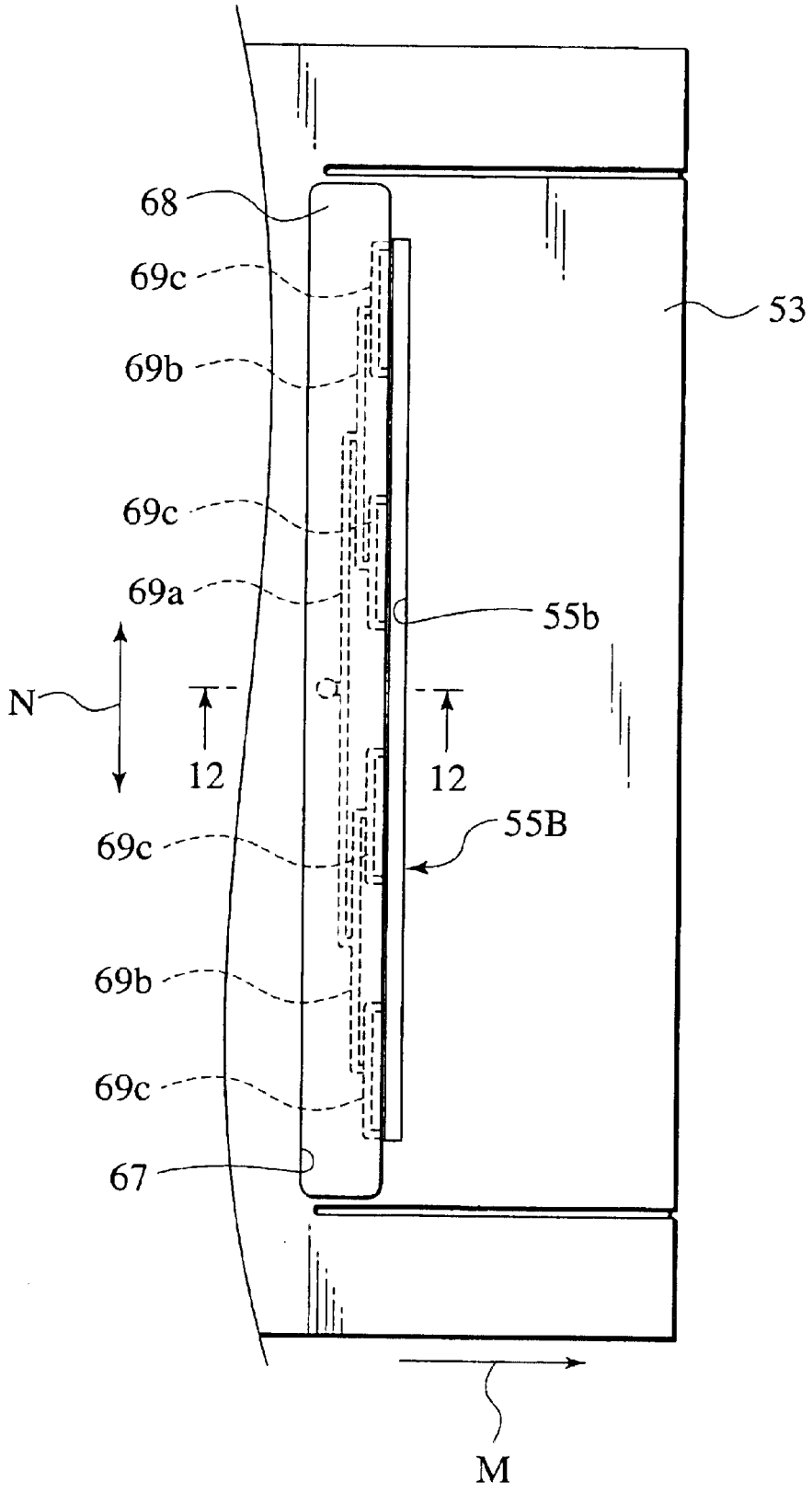
FIG. 11 shows a first modification of the ink supply unit of the first embodiment and is a plan view of the drum showing the ink supply unit.
Figure 12:
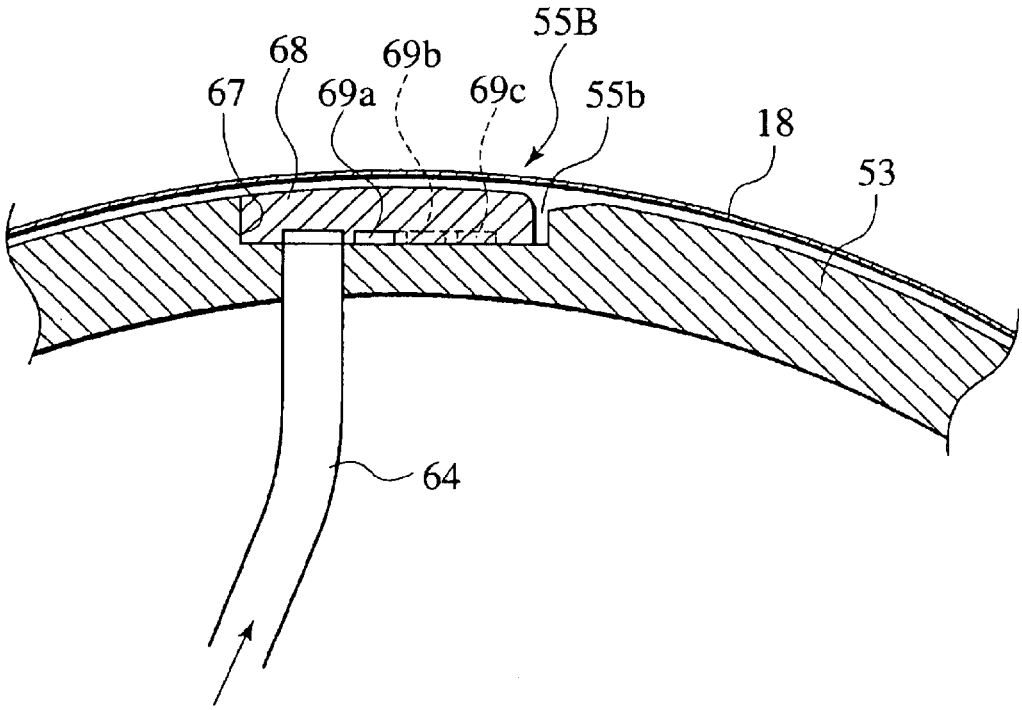
FIG. 12 shows the first modification of the ink supply unit of the first embodiment and is a cross-sectional view taken along the line 12—12 in FIG. 11.

FIGS. 11 and 12 show a first modification of the ink supply unit. FIG. 11 is a plan view of the drum showing the ink supply unit, and FIG. 12 is a cross-sectional view taken along the line 12—12 in FIG. 11.

As shown in FIGS. 11 and 12, an ink supply unit 55B of the first modification includes a first branch passage 69*a* to which the other end of the second pipe 64 is connected, two second branch passages 69*b* branched in two directions from both ends of the first branch passage 69*a*, four third branch passages 69*c* branched in two directions from both ends of each of the second branch passages 69*b*, and the ink supply port 55*b* which communicates with branch holes that are branched in two directions from both ends of these four of the third branch passages 69*c* and placed at an interval in a printing perpendicular direction N, and which serves as an ink diffusing supply portion opened to the surface of the outer peripheral wall 53.

The ink supply unit 55B of the first modification also supplies ink almost uniformly from the ink supply port 55*b* in the printing perpendicular direction N on the outer peripheral wall 53. Therefore, when the ink 56 is diffused downstream in the printing direction M by being squeezed by the pressing force of the pressure roller 35, the ink 56 is diffused without unevenness in the printing perpendicular direction N. Thus, nonuniform densities in the printing perpendicular direction N can be certainly prevented.

Figure 13:
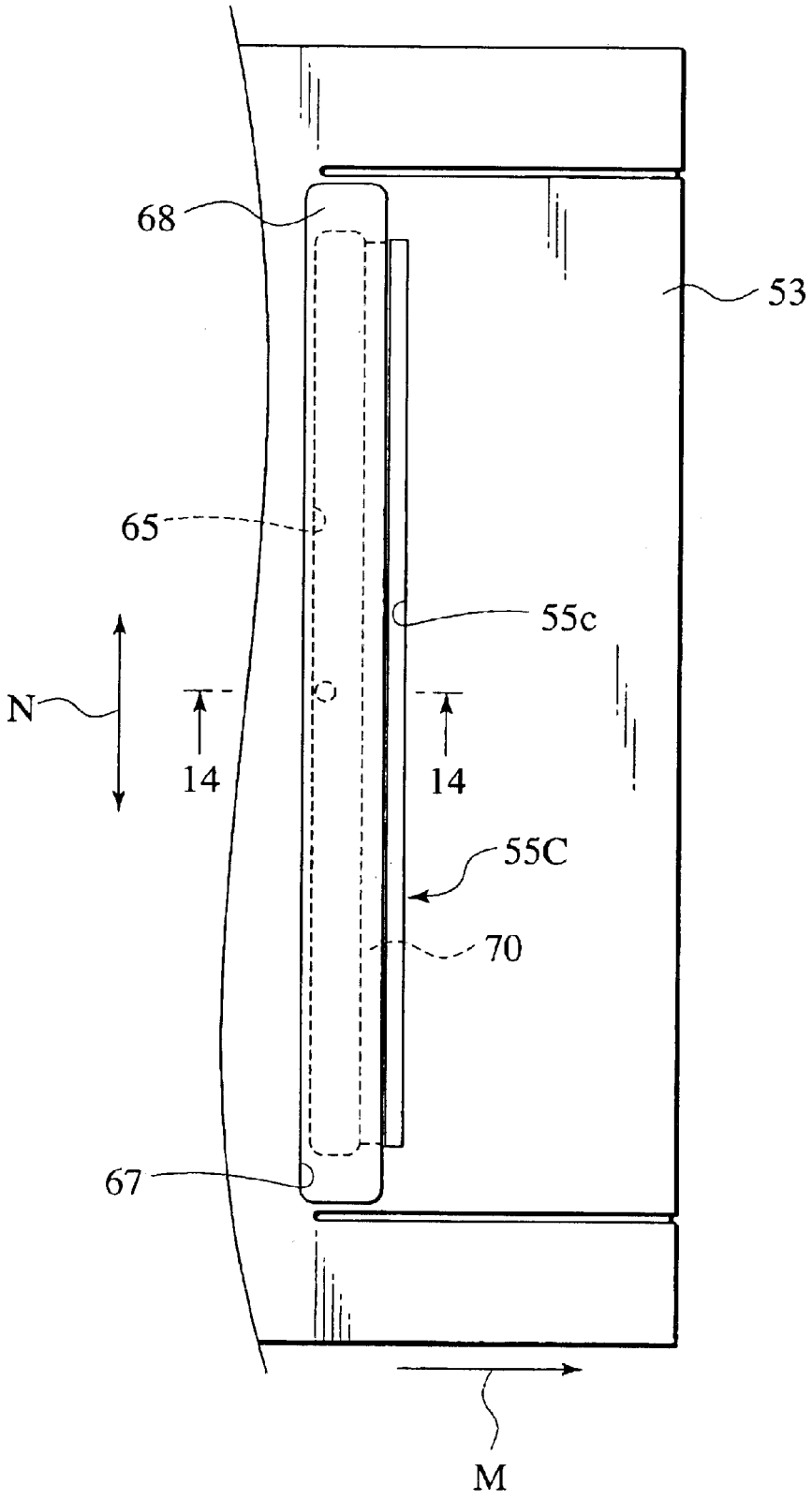
FIG. 13 shows a second modification of the ink supply unit of the first embodiment and is a plan view of the drum showing the ink supply unit.
Figure 14:
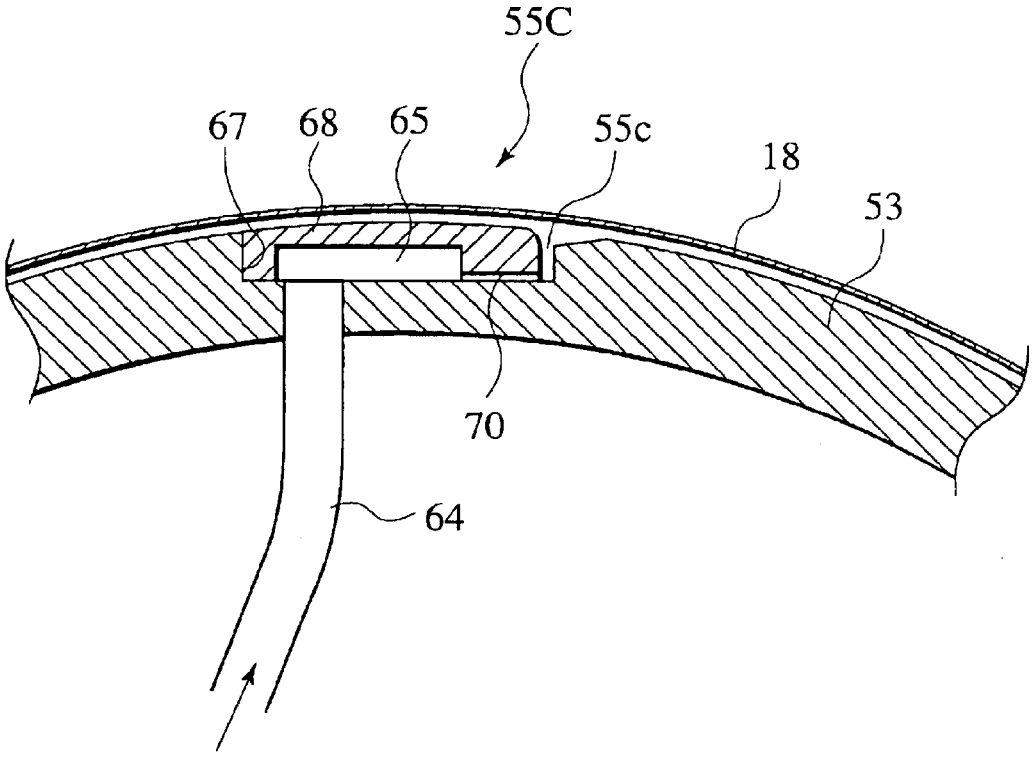
FIG. 14 shows the second modification of the ink supply unit of the first embodiment and is a cross-sectional view taken along the line 14—14 in FIG. 13.

FIGS. 13 and 14 show a second modification of the ink supply unit. FIG. 13 is a plan view of the drum showing the ink supply unit, and FIG. 14 is a cross-sectional view taken along the line 14—14 in FIG. 13.

As shown in FIGS. 13 and 14, an ink supply unit 55C of the second modification includes an ink diffusion groove 65 which diffuses the ink from the second pipe 64 in the printing perpendicular direction N, a slit 70 opened along the printing perpendicular direction N of the ink diffusion groove 65, and an ink supply port 55*c* which communicates with the slit 70 and serves as the ink diffusing supply portion opened to the surface of the outer peripheral wall 53.

The ink supply unit 55C of the second modification also supplies the ink 56 almost uniformly from the ink supply port 55*c* in the printing perpendicular direction N on the outer peripheral wall 53. Therefore, similarly to the first embodiment, when the ink 56 is diffused downstream in the printing direction M by being squeezed by the pressing force of the pressure roller 35, the ink 56 is diffused in the printing perpendicular direction N without unevenness. Thus, nonuniform printing densities in the printing perpendicular direction N is certainly prevented.

Figure 15:
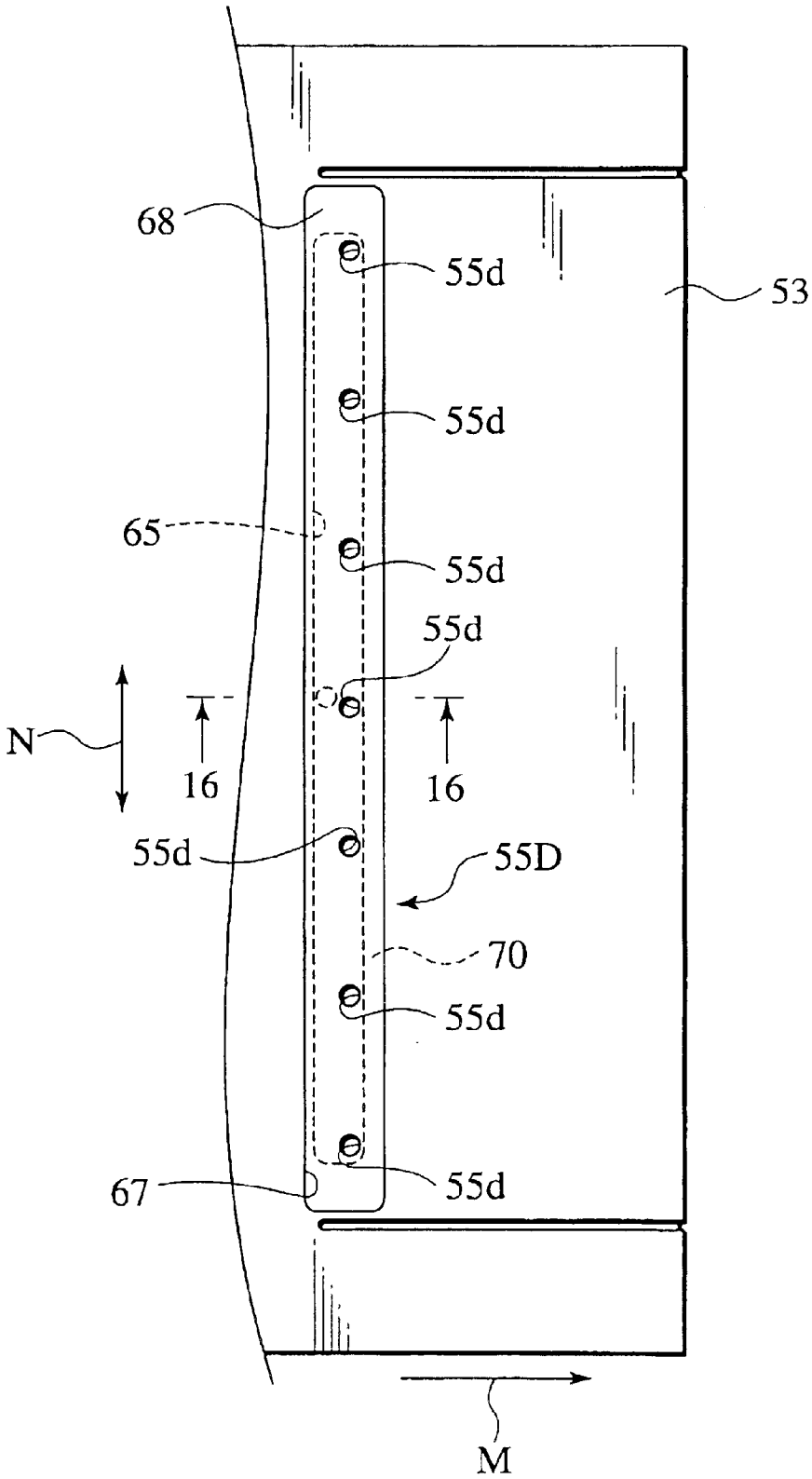
FIG. 15 shows a third modification of the ink supply unit of the first embodiment and is a plan view of a part of the drum.
Figure 16:
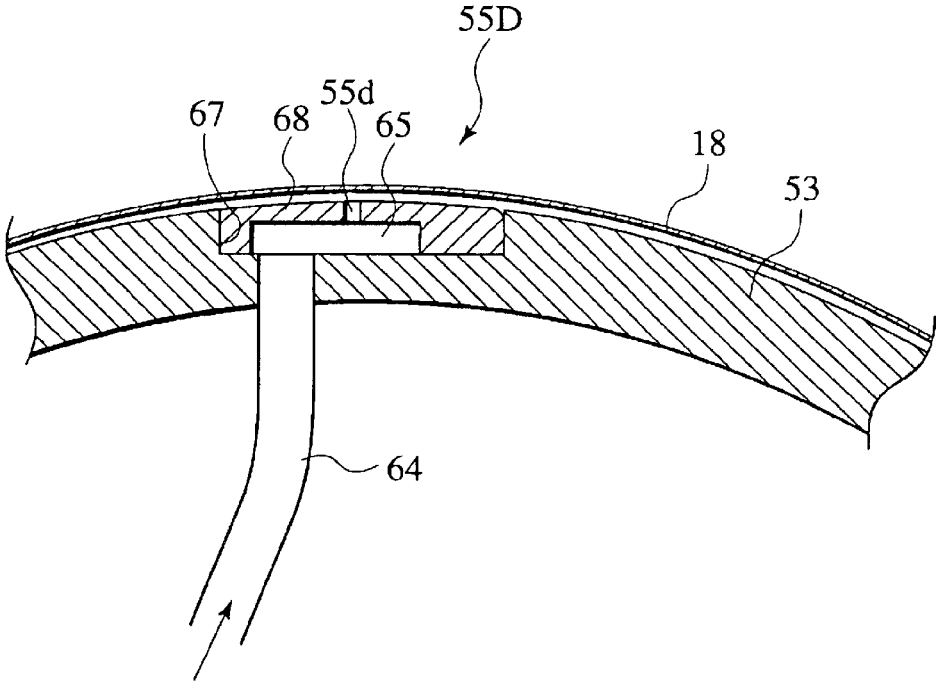
FIG. 16 shows the third modification of the ink supply unit of the first embodiment and is a cross-sectional view taken along the line 16—16 in FIG. 15.

FIGS. 15 and 16 show a third modification of the ink supply unit. FIG. 15 is a plan view of a part of the drum showing the ink supply unit, and FIG. 16 is a cross-sectional view taken along the line 16—16 in FIG. 15.

As shown in FIGS. 15 and 16, an ink supply unit 55D of the third modification includes the ink diffusion groove 65 which diffuses the ink from the second pipe 64 in the printing perpendicular direction N, and a plurality of ink supply ports 55*d*, serving as the ink diffusing supply portions, whose one ends are opened at an interval in the printing perpendicular direction N in the ink diffusion groove 65 and the other ends are opened to the surface of the outer peripheral wall 53. The ink diffusion groove 65 and the ink supply ports 55*d* are formed by the concave portion for ink supply 67, formed along the printing perpendicular direction N on the outer peripheral wall 53, and the ink distribution member 68 placed inside the concave portion 67.

The ink supply unit 55D of the third modification supplies the ink 56 onto the outer peripheral wall 53 in the state of being diffused uniformly toward the entire peripheries of the ink supply ports 55*d*. Thus, when viewing the outer peripheral wall 53 as a whole in the printing perpendicular direction N, the ink 56 is almost uniformly supplied in the printing perpendicular direction N. Therefore, similarly to the first embodiment, when the ink 56 is diffused downstream in the printing direction M by being squeezed by the pressing force of the pressure roller 35, the ink 56 is diffused in the printing perpendicular direction N without unevenness. Therefore, nonuniform printing densities in the printing perpendicular direction N is certainly prevented.

Further, with the ink supply unit 55D of the third embodiment, the pressure roller 35 is not depressed into the ink supply ports 55*d* when passing over the ink supply ports 55*d*. Therefore, depression noise and vibration of the pressure roller 35 can be prevented.

Figure 17:
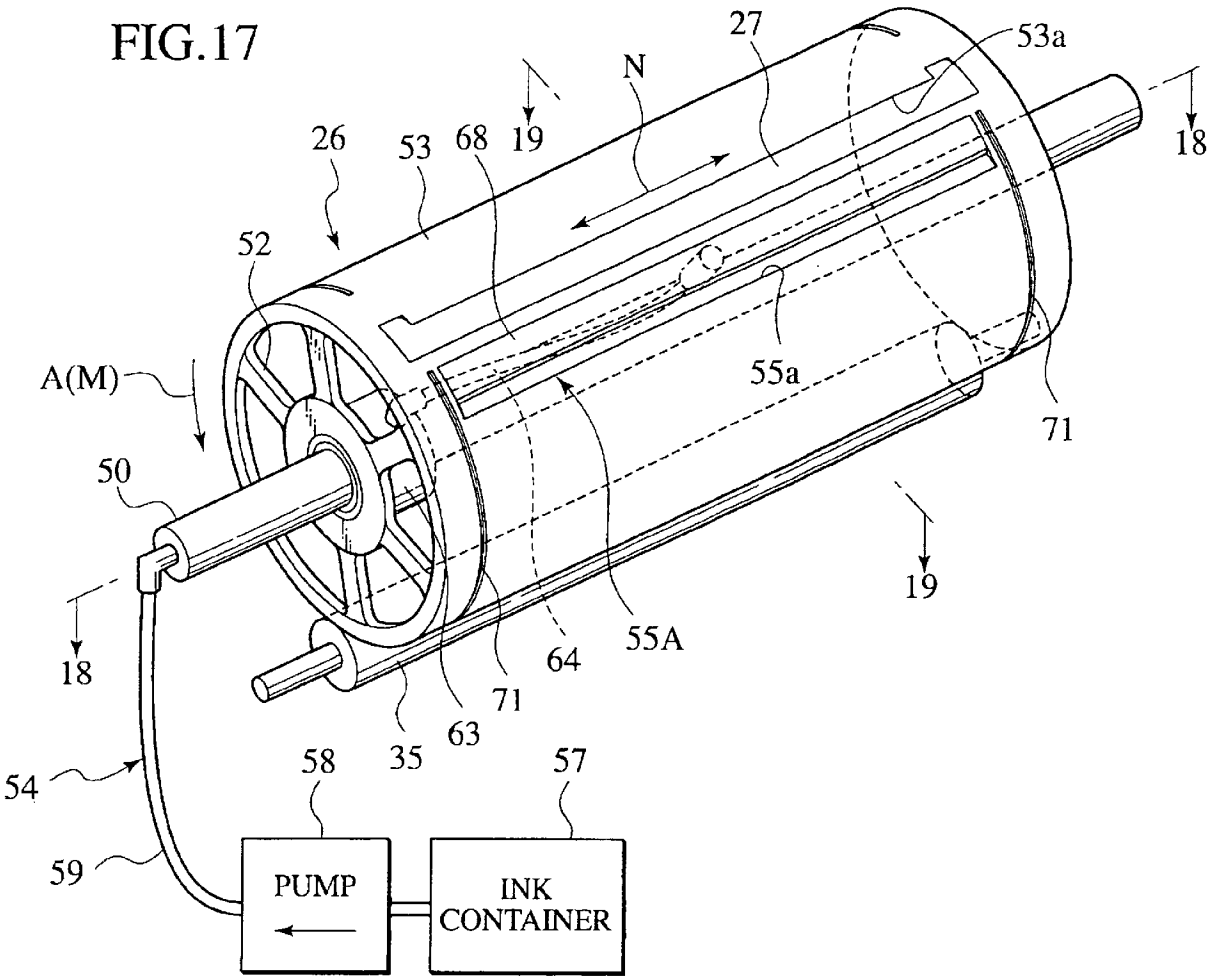
FIG. 17 shows a second embodiment of the present invention and is a perspective view of a drum.
Figure 18:
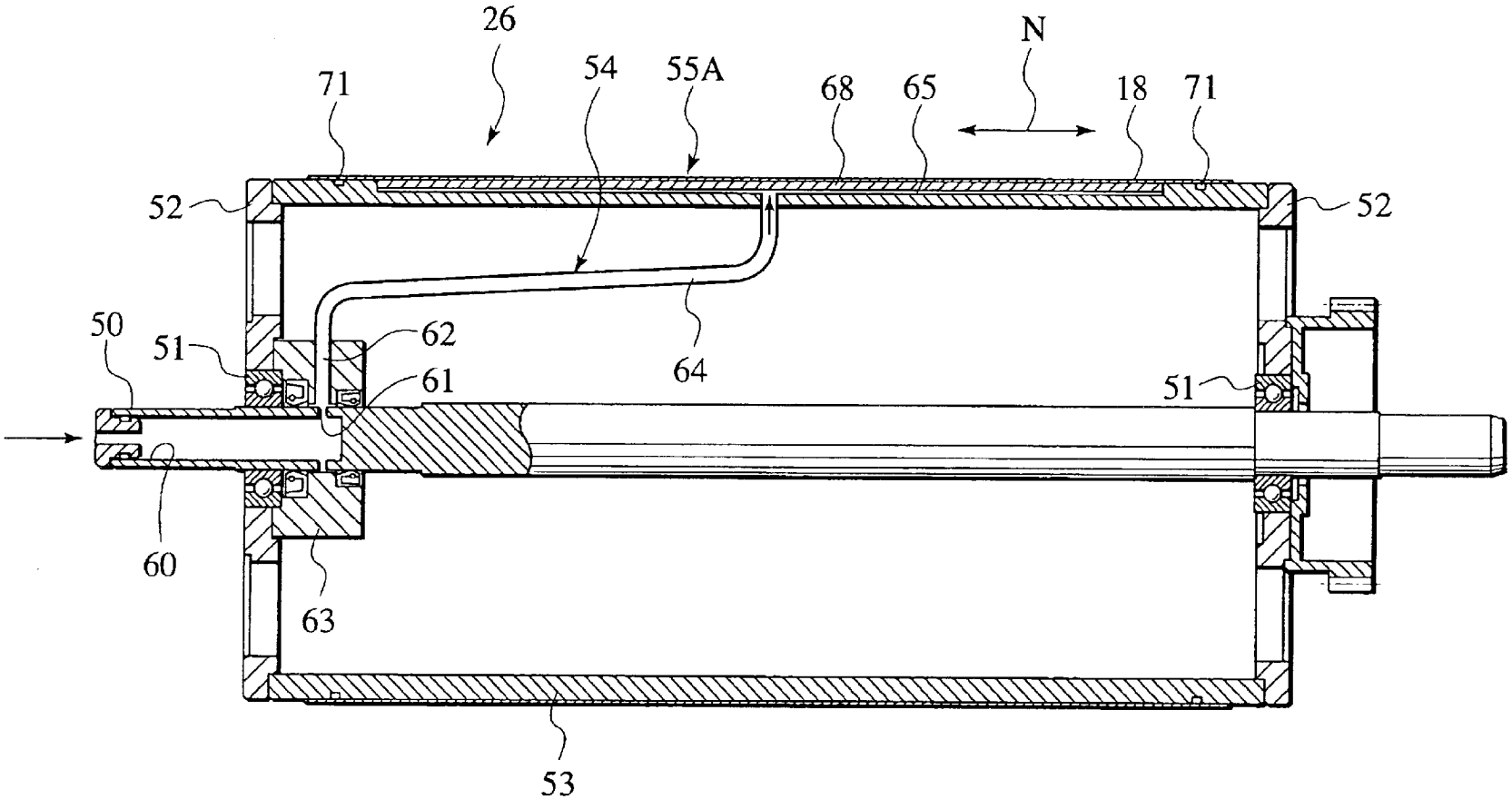
FIG. 18 shows the second embodiment of the present invention and is a cross-sectional view taken along the line 18—18 in FIG. 17.
Figure 19:
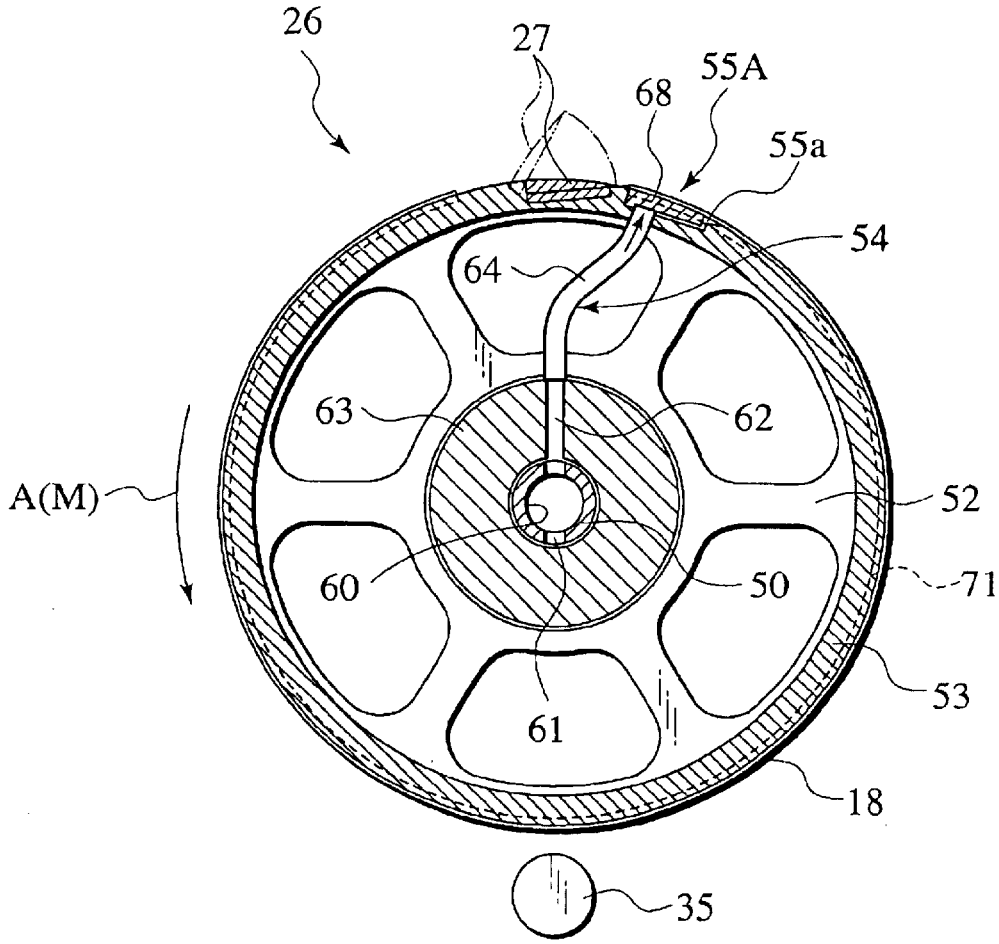
FIG. 19 shows the second embodiment of the present invention and is a cross-sectional view taken along the line 19—19 in FIG. 17.
Figure 20:
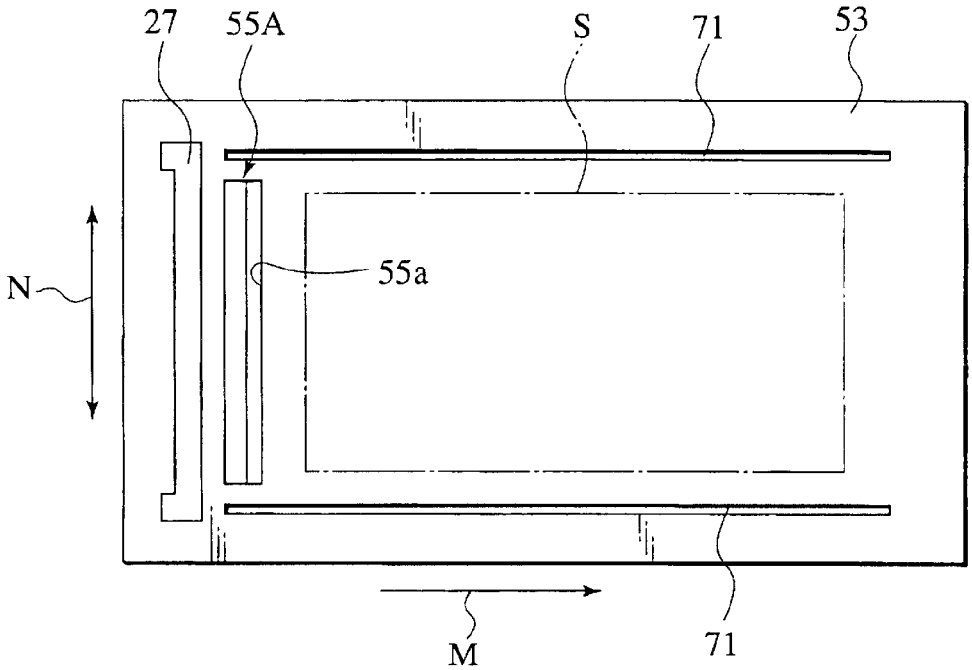
FIG. 20 shows the second embodiment of the present invention and is a schematic view of an exploded outer peripheral wall of the drum.

FIGS. 17 to 20 show a second embodiment of the present invention. FIG. 17 is a perspective view of the drum, FIG. 18 is a cross-sectional view taken along the line 18—18 in FIG. 17, FIG. 19 is a cross-sectional view taken along the line 19—19 in FIG. 17, and FIG. 20 is a schematic view of the exploded outer peripheral wall of the drum.

As shown in FIGS. 17 to 20, in the second embodiment, ink leakage preventing grooves 71 are provided at positions outside of a maximum printing area S of the outer peripheral wall 53 of the drum 26 and covered with the stencil sheet 18. Further, these ink leakage preventing grooves 71 are provided at positions on the right and left sides as well as outside of the maximum printing area S in the printing perpendicular direction N. Furthermore, the ink leakage preventing grooves 71 are continuously formed along, the printing direction M and over a range wider than the maximum printing area S in the printing direction M. Specifically, in order to prevent the leakage of the ink 56 even if the ink 56 is diffused in a horizontal direction from the ink diffusion groove 65 and the ink supply port 55*a*, ends of the ink leakage preventing grooves 71 are preferably arranged at least at the same position as an ink supply position in a drum rotation direction. Moreover, the ink leakage preventing grooves 71 are arranged about 10 mm outside the widths of the ink diffusion groove 65 and the ink supply port 55*a* of the ink supply unit 55A. Note that the rest of the construction is the same as the foregoing first embodiment. Therefore, the same constituents as those in the first embodiment are designated by the same reference numerals, and detailed description thereof is omitted.

In the second embodiment, similarly to the first embodiment, the ink 56 does not deteriorate even when printing is not carried out for a long time. Furthermore, the small and light-weighted drum 26 can be realized.

Moreover, in the second embodiment, the ink leakage preventing grooves 71 are provided at the positions on the right and left sides as well as outside of the maximum printing area S in the printing perpendicular direction N. Therefore, the ink 56 leaking from the maximum printing area S of the outer peripheral wall 53 in the printing perpendicular direction N goes into the ink leakage preventing grooves 71, and thereby the ink leakage from the sides of the outer peripheral wall 53 can be certainly prevented.

Figure 21:
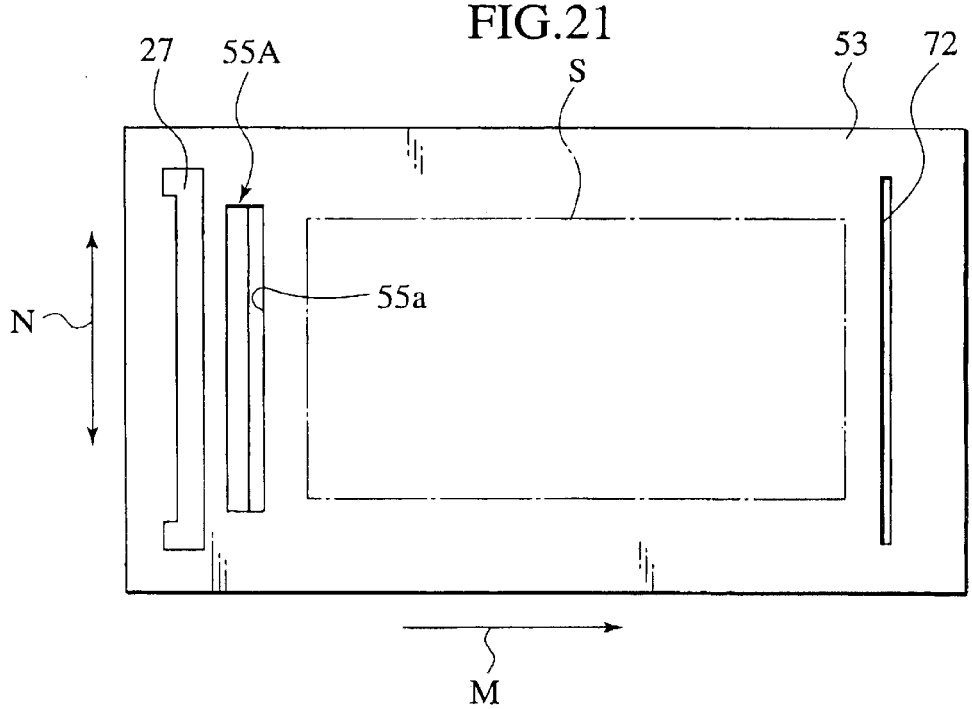
FIG. 21 shows a first modification of an ink leakage preventing groove of the second embodiment and is a schematic view of the exploded outer peripheral wall of the drum.

FIG. 21 shows a first modification of the ink leakage preventing groove of the second embodiment and is a schematic view of the exploded outer peripheral wall of the drum.

As shown in FIG. 21, an ink leakage preventing groove 72 of the first modification is provided at a printing position downstream of the maximum printing area S. It is the position where the ink leakage preventing groove 72 is also covered with the stencil sheet 18. The ink leakage preventing groove 72 is formed continuously along the printing perpendicular direction N (in parallel to the ink supply port 55*a*), and formed over a range wider than the maximum printing area S in the printing perpendicular direction N.

In the first modification, the ink 56 leaking in the printing direction downstream of the maximum printing area S of the outer peripheral wall 53 goes into the ink leakage preventing groove 72. Therefore, ink leakage from the end of the outer peripheral wall 53 can be certainly prevented.

Figure 22:
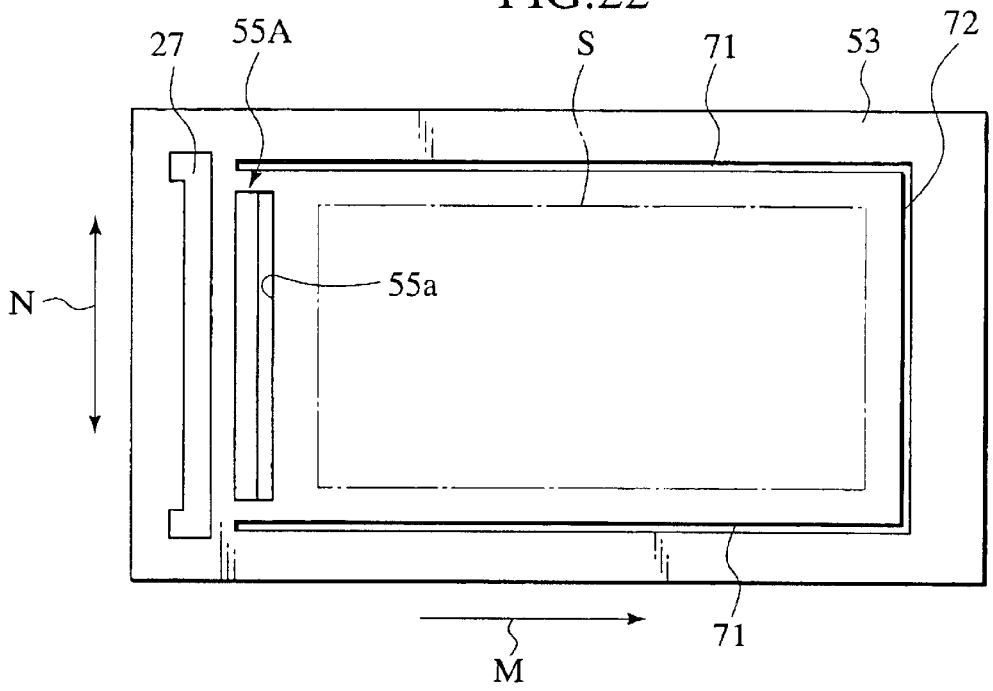
FIG. 22 shows a second modification of the ink leakage preventing groove of the second embodiment and is a schematic view of the exploded outer peripheral wall of the drum.

FIG. 22 shows a second modification of the ink leakage preventing groove of the second embodiment and is a schematic view of the exploded outer peripheral wall of the drum.

As shown in FIG. 22, the ink leakage preventing grooves 71 and 72 of the second modification are combination of the second embodiment and the first modification thereof and formed to have an approximate reverse U shape so as to surround the circumference of the maximum printing area S except the upstream side of the maximum printing area S in the printing direction.

In the second modification, the ink 56 leaking in the printing perpendicular direction N from the maximum printing area S of the outer peripheral wall 53 goes into the ink leakage preventing grooves 71, and the ink 56 leaking in the downstream printing direction from the maximum printing area S goes into the ink leakage preventing groove 72. Therefore, the ink leakage from both sides and end of the outer peripheral wall 53 can be prevented more certainty.

Figure 23:
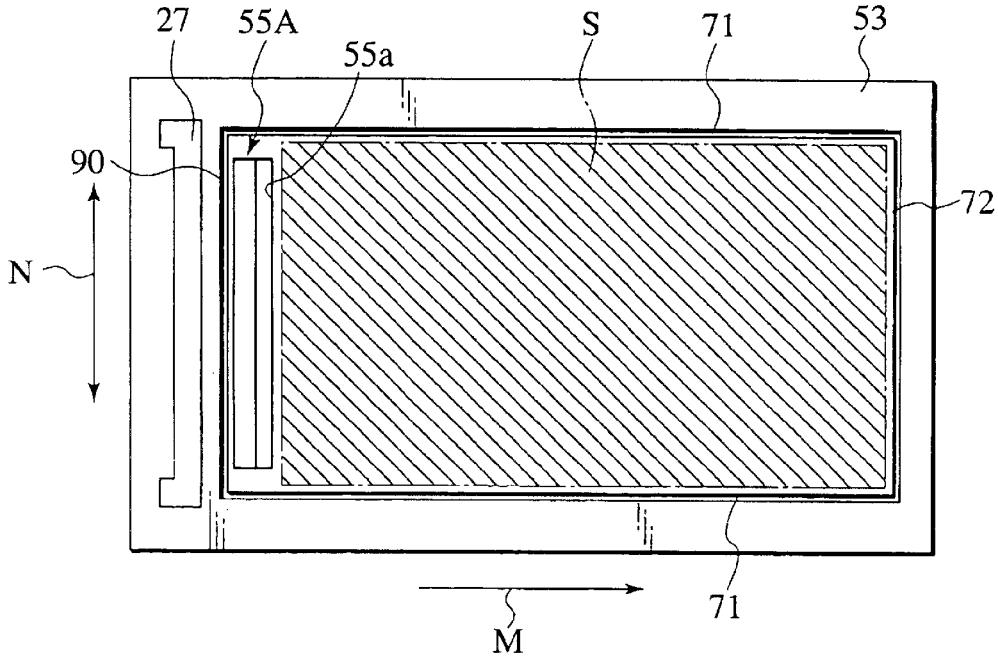
FIG. 23 shows a third modification of the ink leakage preventing groove of the second embodiment and is a schematic view of the exploded outer peripheral wall of the drum.

FIG. 23 shows a third modification of the ink leakage preventing groove of the second embodiment and is a schematic view of the exploded outer peripheral wall of the drum.

As shown in FIG. 23, ink leakage preventing grooves 71, 72 and 90 are formed to have an approximate quadrangle shape so as to surround the entire circumference of the maximum printing area S. Specifically, in comparison with the second modification, the ink leakage preventing groove 90 is added at a printing position upstream of the maximum printing area S, and between the ink supply port 55*a* and the stencil sheet clamping portion 27. The ink leakage preventing groove 90 is placed at the position covered with the stencil sheet 18 and continuously provided to have a straight shape along the printing perpendicular direction N.

In the third modification, since the ink 56 leaking in a printing direction upstream of the maximum printing area S of the outer peripheral wall 53 goes into the ink leakage preventing groove 90, the ink leakage from the top of the outer peripheral wall 53 can be certainly prevented. Specifically, in the third modification, the ink leakage from any directions of the maximum printing area S can be prevented. Since the ink leakage from the top of the maximum printing area S can be prevented, bad clamping, bad stencil loading, and the creased stencil sheet 18 caused by contamination of the stencil sheet clamping portion 27 by the ink 56 can be prevented.

Figure 24:
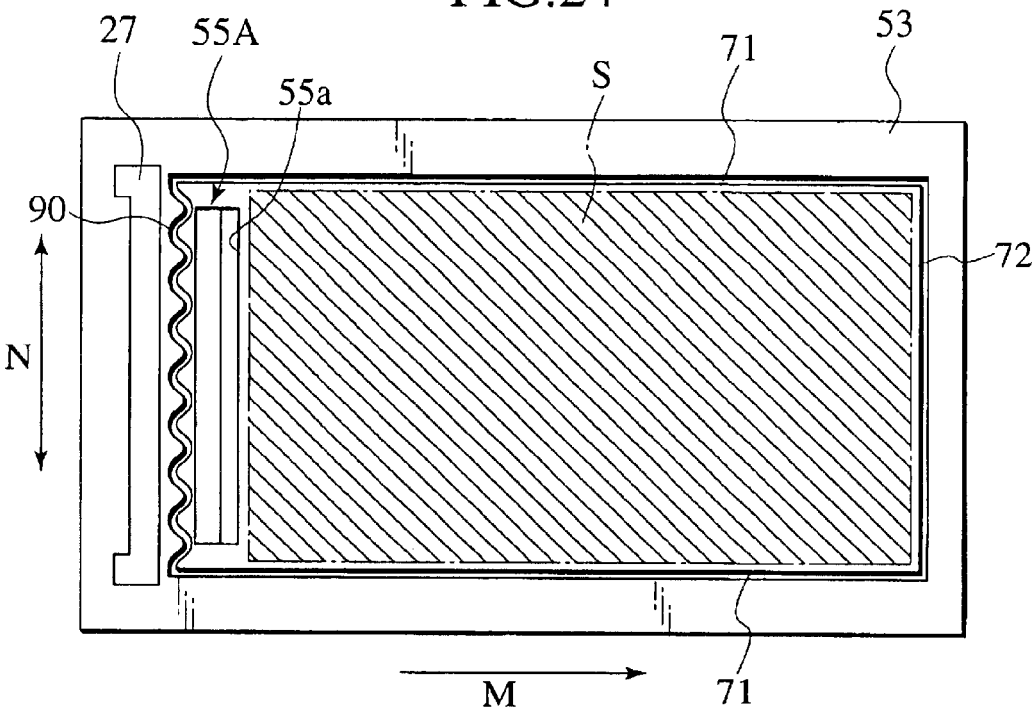
FIG. 24 shows a fourth modification of the ink leakage groove of the second embodiment and is a schematic view of the exploded outer peripheral wall of the drum.

FIG. 24 shows a fourth modification of the ink leakage preventing groove of the second embodiment and is a schematic view of the exploded outer peripheral wall of the drum.

As shown in FIG. 24, similarly to the third modification, the ink leakage preventing grooves 71, 72 and 90 are formed so as to surround the entire circumference of the maximum printing area S. However, in comparison with the third modification, the ink leakage preventing groove 90 is formed to have a wavy shape in stead of the straight shape.

In the forth modification, similarly to the third modification, the ink 56 leaking in the printing direction upstream of the maximum printing area S of the outer peripheral wall 53 also goes into the ink leakage preventing groove 90. Therefore, the ink leakage from the top of the outer peripheral wall 53 can be prevented. In addition, the pressure roller 35 is not depressed into the ink leakage preventing groove 90 when passing over the ink leakage preventing groove 90. Therefore, depression noise and vibration of the pressure roller 35 can be prevented.

Figure 25:
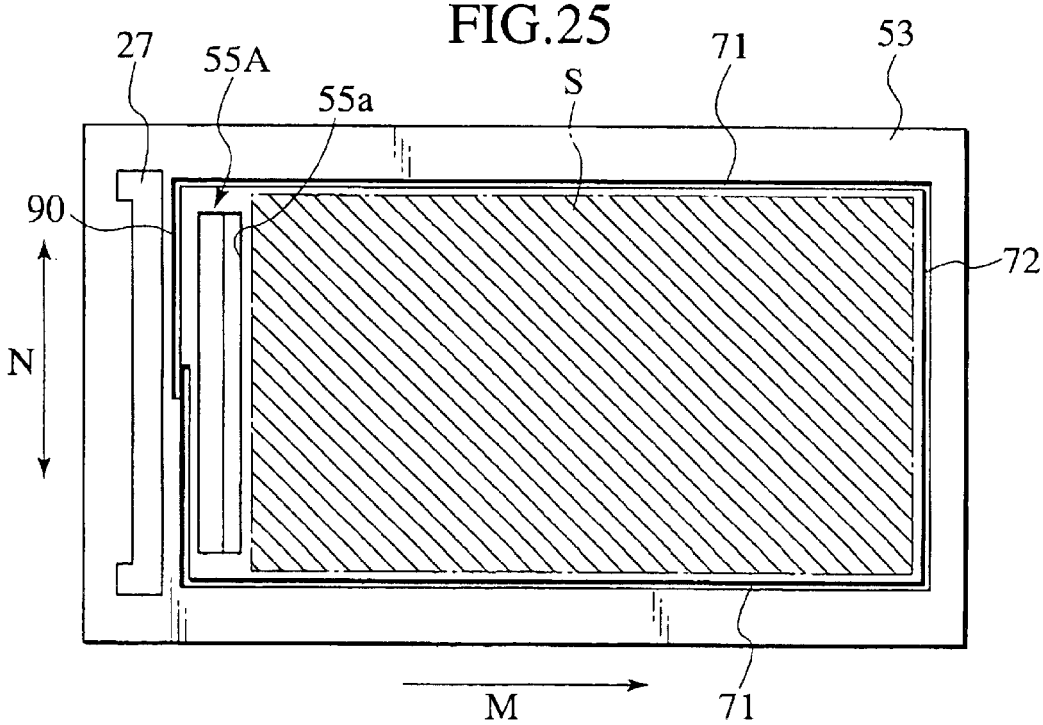
FIG. 25 shows a fifth modification of the ink leakage preventing groove of the second embodiment and is a schematic view of the exploded outer peripheral wall of the drum.

FIG. 25 is a fifth modification of the ink leakage preventing groove of the second embodiment and is a schematic view of the exploded outer peripheral,wall of the drum.

As shown in FIG. 25, similarly to the third modification, the ink leakage preventing grooves 71, 72 and 90 are formed so as to surround the entire circumference of the maximum printing area S. However, in comparison with the third modification, the left half and the right half of the ink leakage preventing groove 90 in the printing perpendicular direction N are formed at positions that are slightly dislocated in the printing direction M.

In the fifth modification, similarly to the third modification, the ink 56 leaking in the printing direction upstream of the maximum printing area S of the outer peripheral wall 53 also goes into the ink leakage preventing groove 90. Therefore, the ink leakage from the top of the outer peripheral wall 53 can be certainly prevented. In addition, similarly to the fourth modification, the pressure roller 35 is not virtually depressed into the ink leakage preventing groove 90 when passing over the ink leakage preventing groove 90. Therefore, depression noise and vibration of the pressure roller 35 can be prevented.

Figure 26:
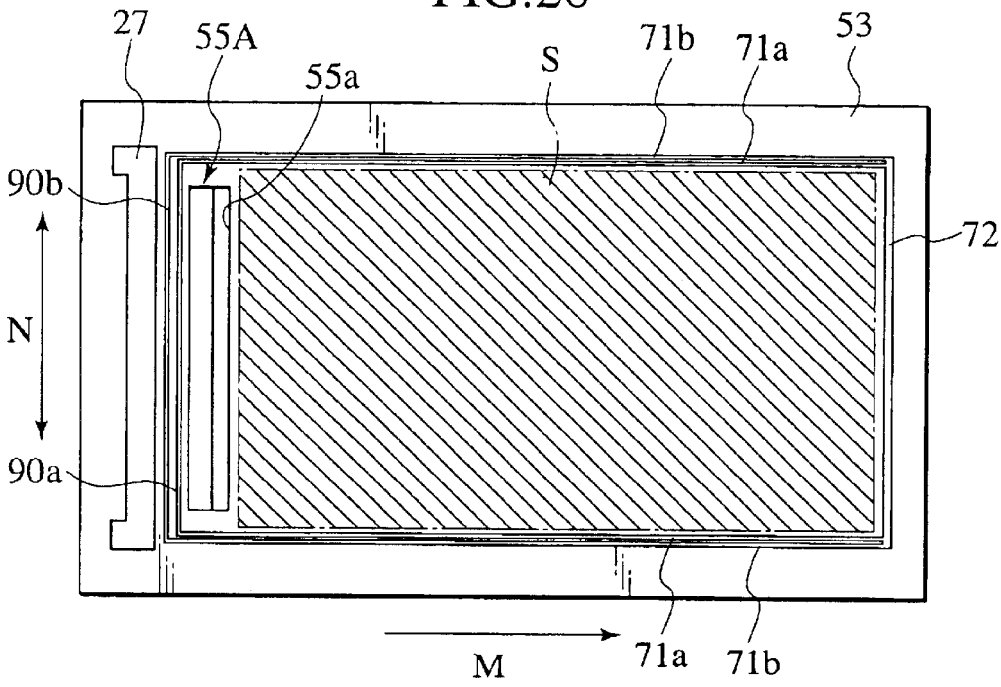
FIG. 26 shows a sixth modification of the ink leakage preventing groove of the second embodiment and is a schematic view of the exploded outer peripheral wall of the drum.

FIG. 26 shows a sixth modification of the ink leakage preventing groove of the second embodiment and is a schematic view of the exploded outer peripheral wall of the drum.

As shown in FIG. 26, similarly to the third modification, ink leakage preventing grooves 71*a*, 71*b*, 72, 90*a* and 90*b* are formed to have an approximate quadrangle shape so as to surround the entire circumference of the maximum printing area S. However, in comparison with the third modification, the respective ink leakage preventing grooves 71*a*, 71*b*, 90*a* and 90*b* at positions on the right and left as well as outside of the maximum printing area S, and the upstream position of the same, respectively have narrow widths and are doubly formed in inner and outer peripheries.

In the sixth modification, similarly to the third modification, the ink 56 leaking in the printing direction upstream of the maximum printing area S of the outer peripheral wall 53 also goes into the ink leakage preventing groove 90. Therefore, the ink leakage from the top of the outer peripheral wall 53 can be certainly prevented.

Figure 27A:
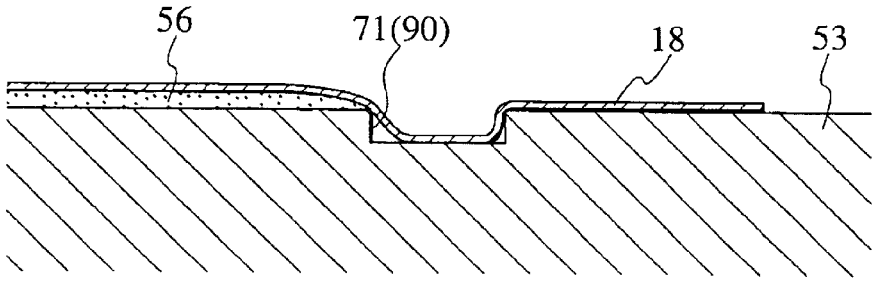
FIG. 27A is a cross-sectional view showing a state where a stencil sheet is depressed into the ink leakage preventing groove.
Figure 27B:
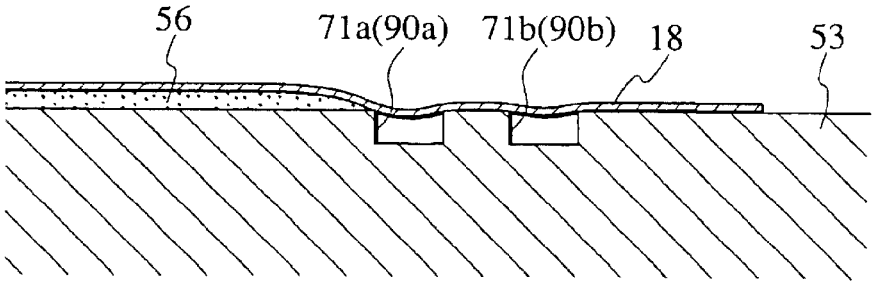
FIG. 27B is a cross-sectional view explaining that the stencil sheet is not depressed into the ink leakage preventing groove of the sixth modification.

Further, in the sixth modification, when the ink 56 in the ink leakage preventing grooves 71*a*, 71*b*, 72, 90*a* and 90*b* is recovered by suction (described in an embodiment below), a deficiency caused by depression of the stencil sheet 18 into the ink leakage preventing grooves 71*a*, 71*b*, 90*a* and 90*b* can be prevented. Specifically, as shown in FIG. 27A, when the ink leakage preventing grooves 71 and 90 have wide widths, the stencil sheet 18 is depressed into the ink leakage preventing grooves 71 and 90 due to suction power or the like. Then, the suction power stops acting on the ink leakage preventing grooves 71 and 90 at the upstream of the depressed positions, causing a problem that the ink recovery cannot be carried out. Contrary to this, as shown in FIG. 27B, when the ink leakage preventing grooves 71*a*, 71*b*, 90*a* and 90*b*, each having a narrow width, are doubly arranged, the stencil sheet 18 is not depressed into the ink leakage preventing grooves 71*a*, 71*b*, 90*a* and 90*b*. Therefore, the ink recovery can be carried out without obstacles. Further, since the ink leakage preventing grooves 71*a*, 71*b*, 90*a* and 90*b* are arranged at two positions, approximately the same total volume for housing the ink can be ensured.

In the sixth modification, the ink leakage preventing grooves 71*a*, 71*b*, 90*a* and 90*b* are doubly formed. As a matter of course, however, the ink leakage preventing grooves 71*a*, 71*b*, 90*a* and 90*b* may be formed triply or more depending on toughness of the stencil sheet 18. Furthermore, in the sixth modification, the ink leakage preventing groove 72 downstream of the maximum printing area S in the printing direction is singly formed. However, it may be doubly formed.

Figure 28:
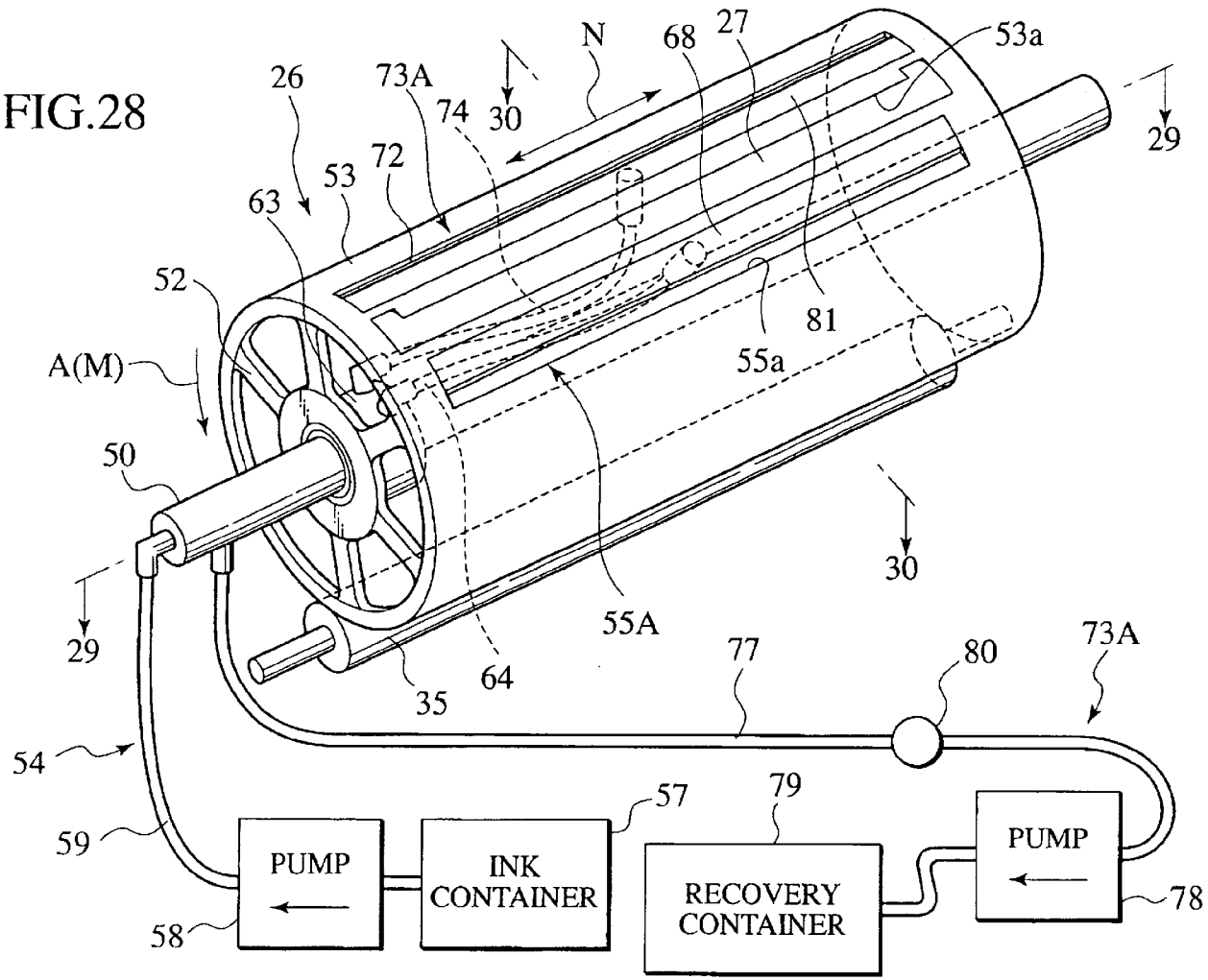
FIG. 28 shows a third embodiment of the present invention and is a perspective view of a drum.
Figure 29:
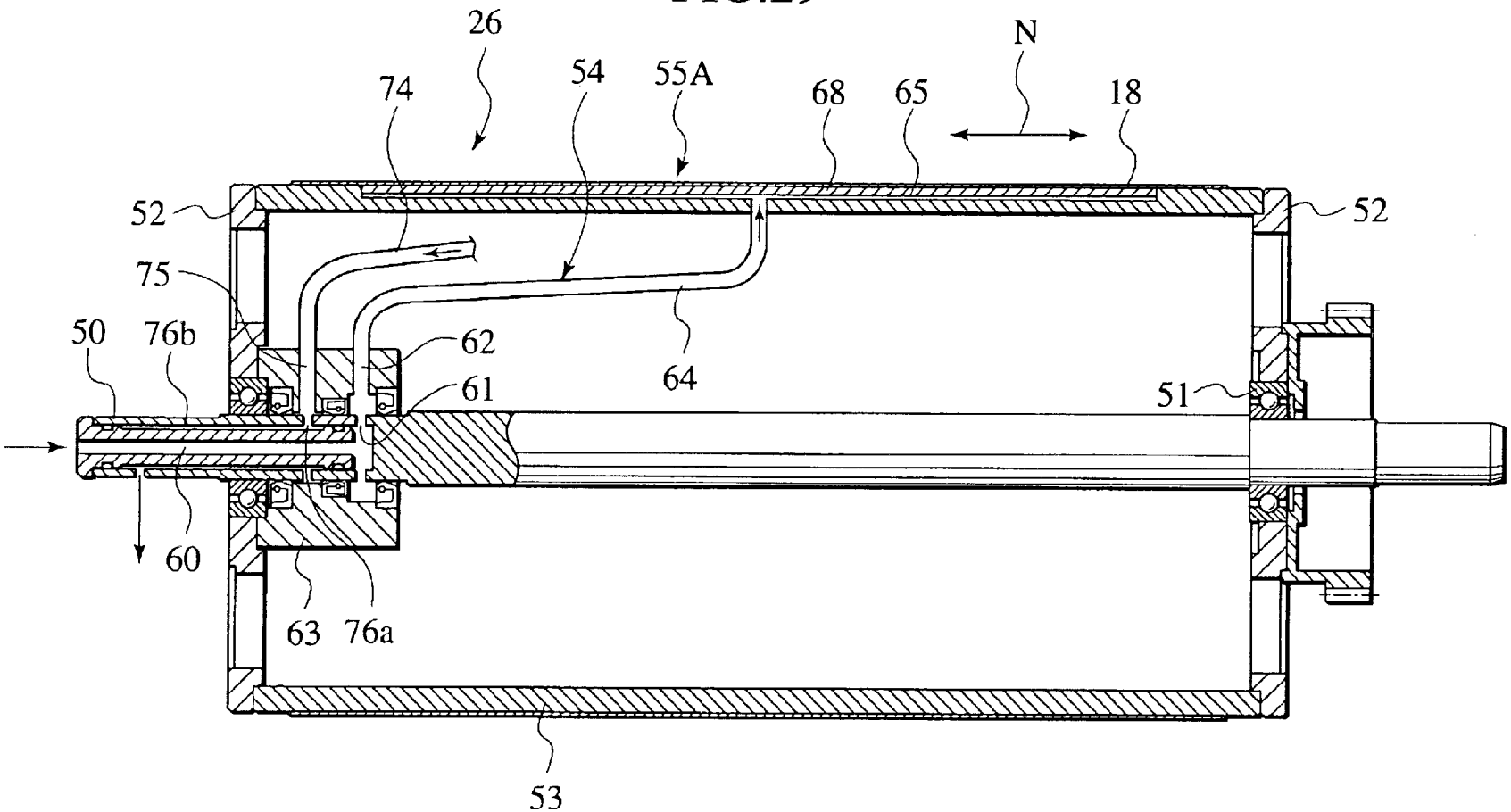
FIG. 29 shows the third embodiment of the present invention and is a cross-sectional view taken along the line 29—29 in FIG. 28.
Figure 30:
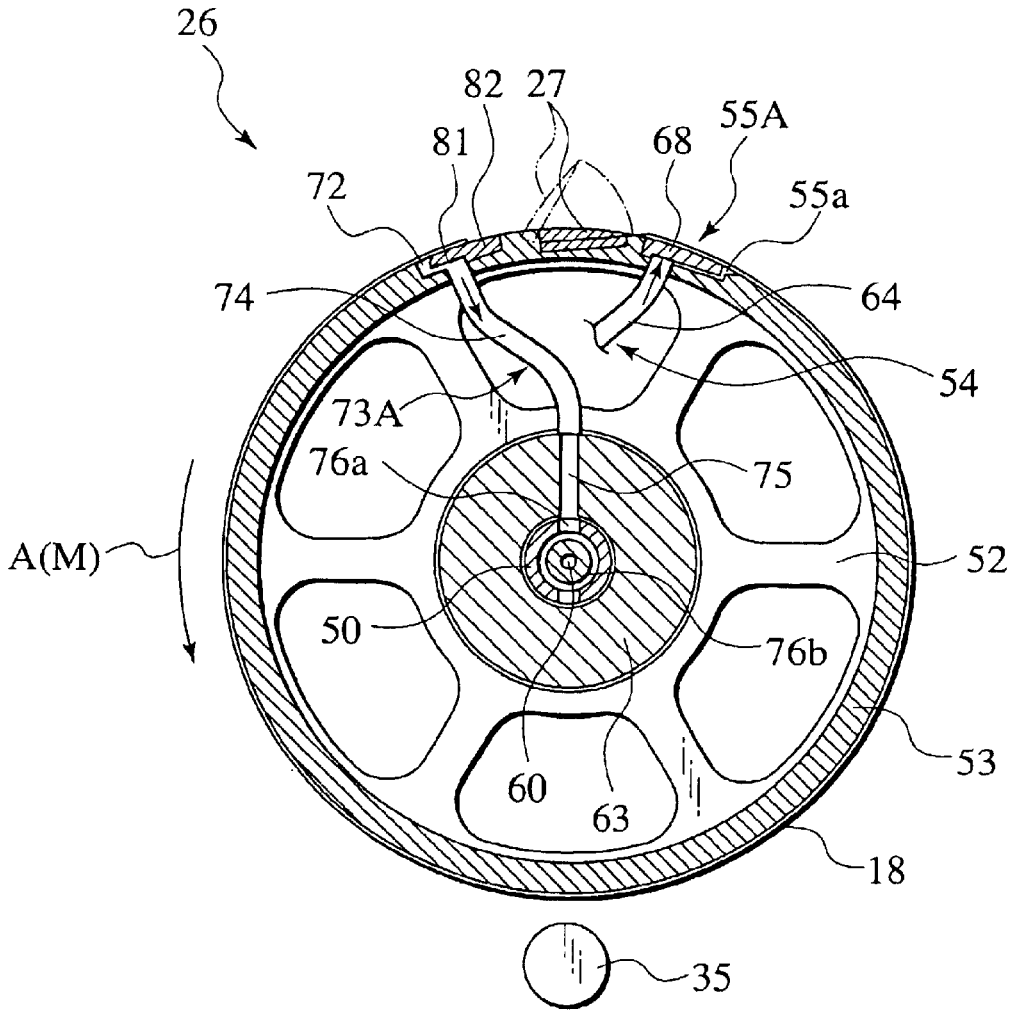
FIG. 30 shows the third embodiment of the present invention and is a cross-sectional view taken along the line 30—30 in FIG. 28.

FIGS. 28 to 30 show a third embodiment of the present invention. FIG. 28 is a perspective view of the drum, FIG. 29 is a cross-sectional view taken along the line 29—29 in FIG. 28, and FIG. 30 is a cross-sectional view taken along the line 30—30 in FIG. 28.

As shown in FIGS. 28 to 30, in the third embodiment, in comparison with the first embodiment, an ink recovery device 73A which recovers the ink 56 leaking from the maximum printing area S of the outer peripheral wall 53 is added.

This ink recovery device 73A includes the ink leakage preventing groove 72 formed at the printing position downstream of the maximum printing area S of the outer peripheral wall 53, a third pipe 74 to which one end of the ink leakage preventing groove 72 is opened, the rotary joint 63 to which the other end of the third pipe 74 is connected and in which a through hole 75 is formed, the support axis 50 which rotatably supports the rotary joint 63 and has a hole 76*a* that can communicate with the through hole 75 and ink passage 76*b* formed therein, a fourth pipe 77 one end of which is connected to the support axis 50, a filter 80 intervening the middle of the fourth pipe 77 and trapping paper particles and the like, an inking pump (for example, a trochoid pump) 78 which is placed in the middle of the fourth pipe 77 and suctions the ink 56 within the fourth pipe 77, and a recovery container 79 to which the other end of the fourth pipe 77 is connected.

The ink leakage preventing groove 72 is placed at the same position as that in the first modification of the second embodiment. The ink leakage preventing groove 72 is placed at the printing position downstream of the maximum printing area S and formed continuously along the printing perpendicular direction N. However, one end of the third pipe 74 is connected to the ink leakage preventing groove 72. Therefore, the ink leakage preventing groove 72 is formed by utilizing a concave portion for ink recovery 81 and a pipe fixing member 82 formed in the concave portion 81. The rotary joint 63 used herein is also used for the ink supply device 54. The support axis 50 has a double pipe structure as it is used for an ink passage for the ink supply device 54. The rest of the construction is the same as that of the foregoing first embodiment. Therefore, the same constituents are designated by the same reference numerals, and detailed description thereof is omitted.

In the third embodiment, similarly to the first embodiment, the ink 56 does not deteriorate either even when printing is not carried out for a long time. Further, the small and light-weighted drum 26 can be realized.

In the third embodiment, the ink recovery device 73A is provided, which recovers the ink 56 leaking outside of the maximum printing area S of the outer peripheral wall 53. Therefore, the excessive ink 56 can be removed from the outer peripheral wall 53 of the drum 26, and recycling of the ink 56 can be realized. In addition, since the ink stored in the ink leakage preventing groove 72 can be recovered, the ink 56 can be certainly prevented from overflowing from the ink leakage preventing groove 72.

In the third embodiment, the ink container 57 for ink supply and the ink recovery container 79 for ink recovery are provided. Therefore, the recovered ink may not be recycled.

In the third embodiment, the filter 80 intervenes the way of the fourth pipe 77 of the ink recovery device 73A, the ink which does not contain paper particles and the like can be surely returned to the ink recovery container 79. Thus, the quality of the recovered ink can be improved. However, the filter 80 is not always necessary to recover the ink, and the filter 80 may be omitted. In addition, though the filter 80 is provided for the ink recovery device 83 of the first and second modifications and in the fourth embodiment, the filter 80 also may be omitted.

In the third embodiment, when the ink supply device 54 and the ink recovery device 73A are controlled so that they are always driven in the printing mode, the ink is continuously supplied to the outer peripheral wall 53 from the ink supply unit 55A in the printing mode. Then, the ink 56 that has flown into the ink leakage preventing groove 72 from the outer peripheral wall 53 is always recovered. Therefore, the ink 56 is prevented from being built up on the outer peripheral wall 53 as soon as possible. Further, an adequate volume of the ink 56 can be always held on the outer peripheral wall 53. Accordingly, a printed sheet with a desired ink density can be obtained even when large-volume and continuous printing is conducted. Incidentally, the ink leakage preventing groove 72 may be arranged as the second embodiment.

In addition, though the ink supply unit 55A as the ink supply device 54 in the first embodiment is used in the third embodiment, the ink supply units 55B, 55C, 55D of the first to third modifications (FIGS. 11 to 16) can be used in the third embodiment. Though the ink leakage preventing groove 72 in the first modification of the second embodiment is used in the third embodiment, the ink leakage preventing groove 71, 71*a*, 71*b*, 72, 90, 90*a*, 90*b* (FIGS. 22 to 27B) can be used in the third embodiment.

Figure 31:
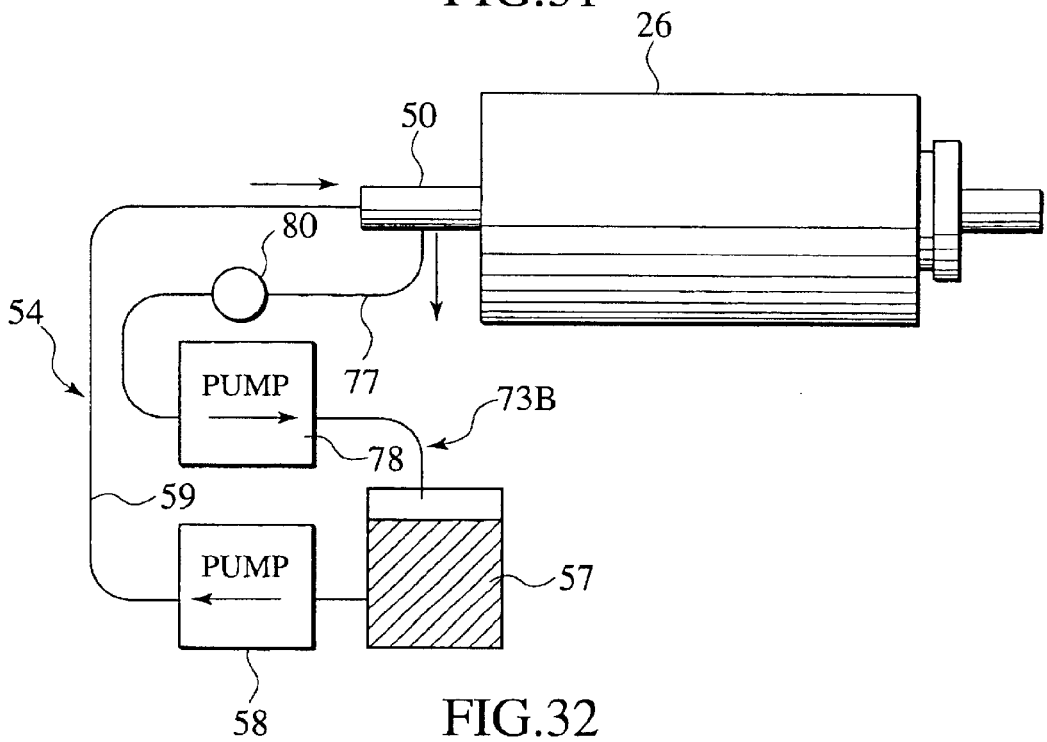
FIG. 31 shows a first modification of the present invention of an ink recovery device of the third embodiment, and is a schematic view of the ink recovery device.

FIG. 31 shows a first modification of the ink recovery device of the third embodiment and is a schematic view of the ink recovery device.

As shown in FIG. 31, in an ink recovery device 73B of the first modification, the other end of the fourth pipe 77 is connected to the ink container 57 for ink supply, instead of the recovery container. Accordingly, the recovered ink can be recycled immediately.

Figure 32:
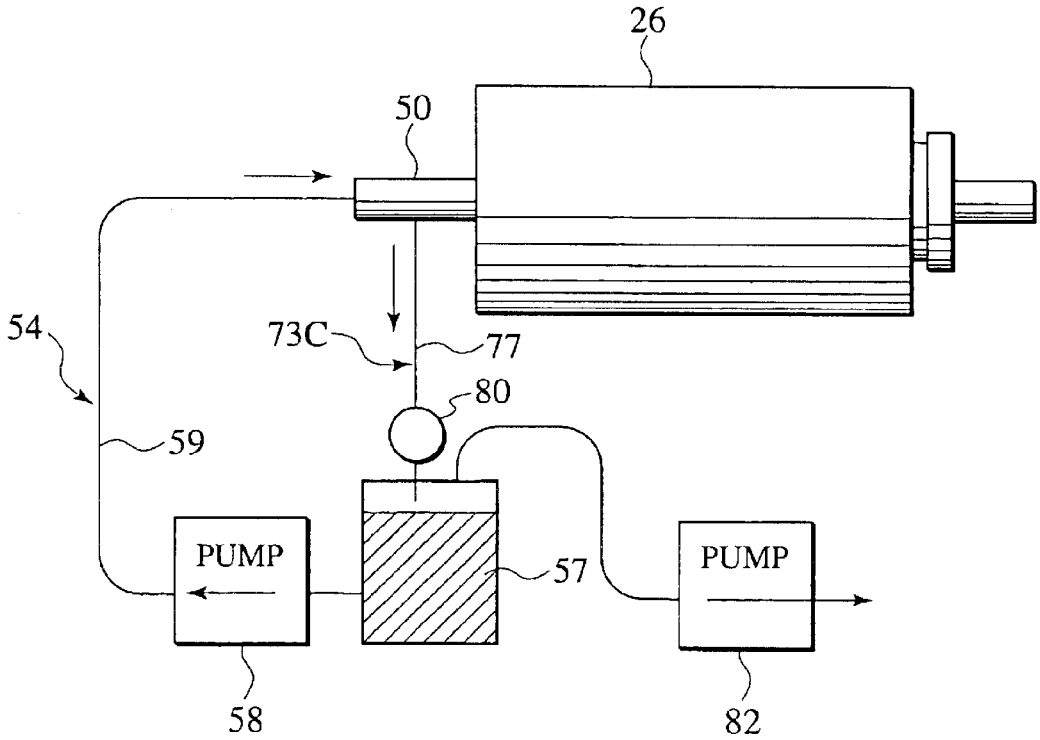
FIG. 32 shows a second modification of the ink recovery device of the third embodiment and is a schematic view of the ink recovery device.

FIG. 32 shows a second modification of the ink recovery device of the third embodiment and is a schematic view of the ink recovery device.

As shown in FIG. 32, in ink recovery device 73C of the second modification, the end of the fourth pipe 77 is connected to the ink container 57 for ink supply, and a vacuum (pressure-reducing) pump 82 which reduces pressure in the ink container 57 is used as an inking pump. In this case, the recovered ink can also be recycled immediately.

Figure 33:
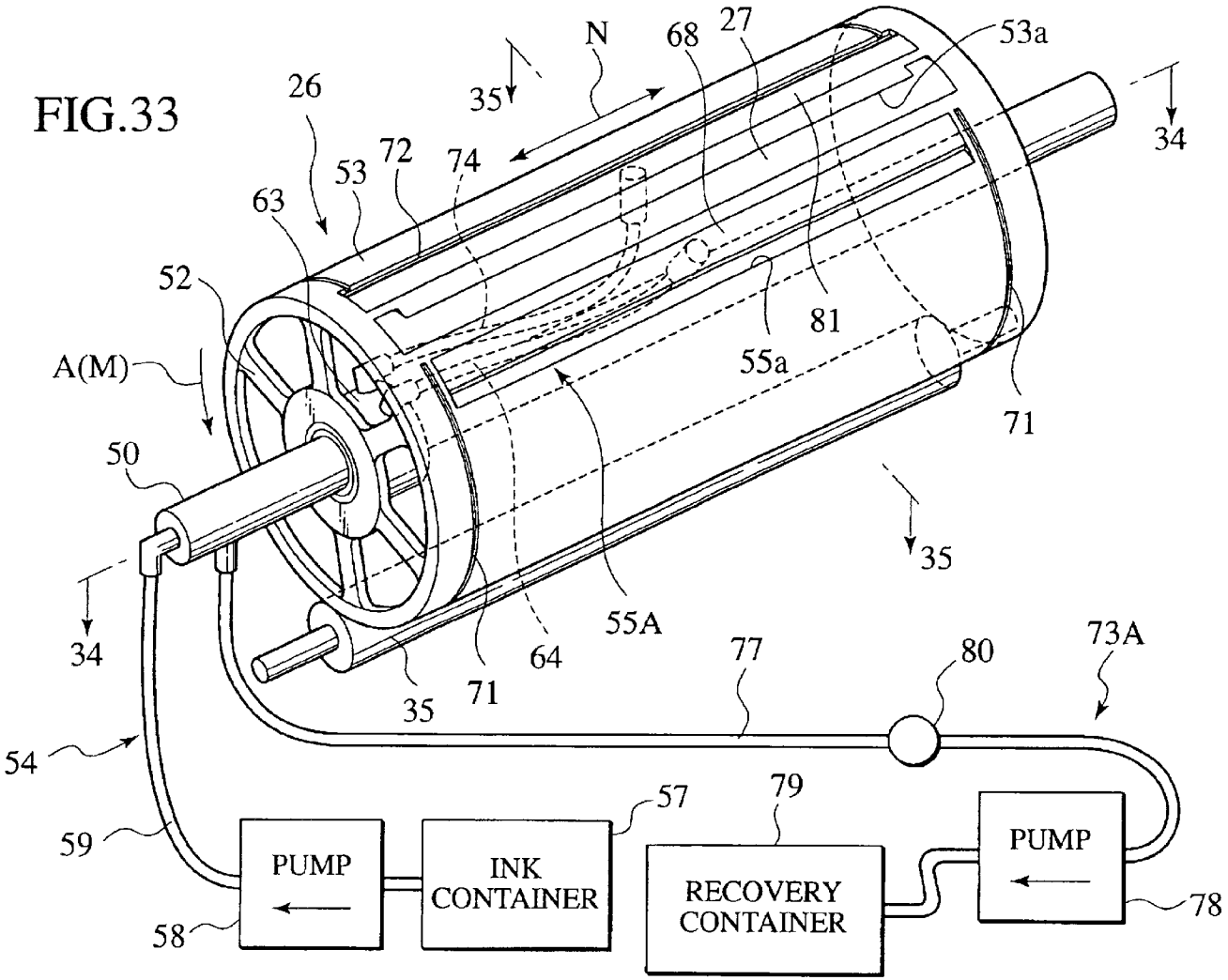
FIG. 33 shows a fourth embodiment of the present invention and is a perspective view of a drum.
Figure 34:
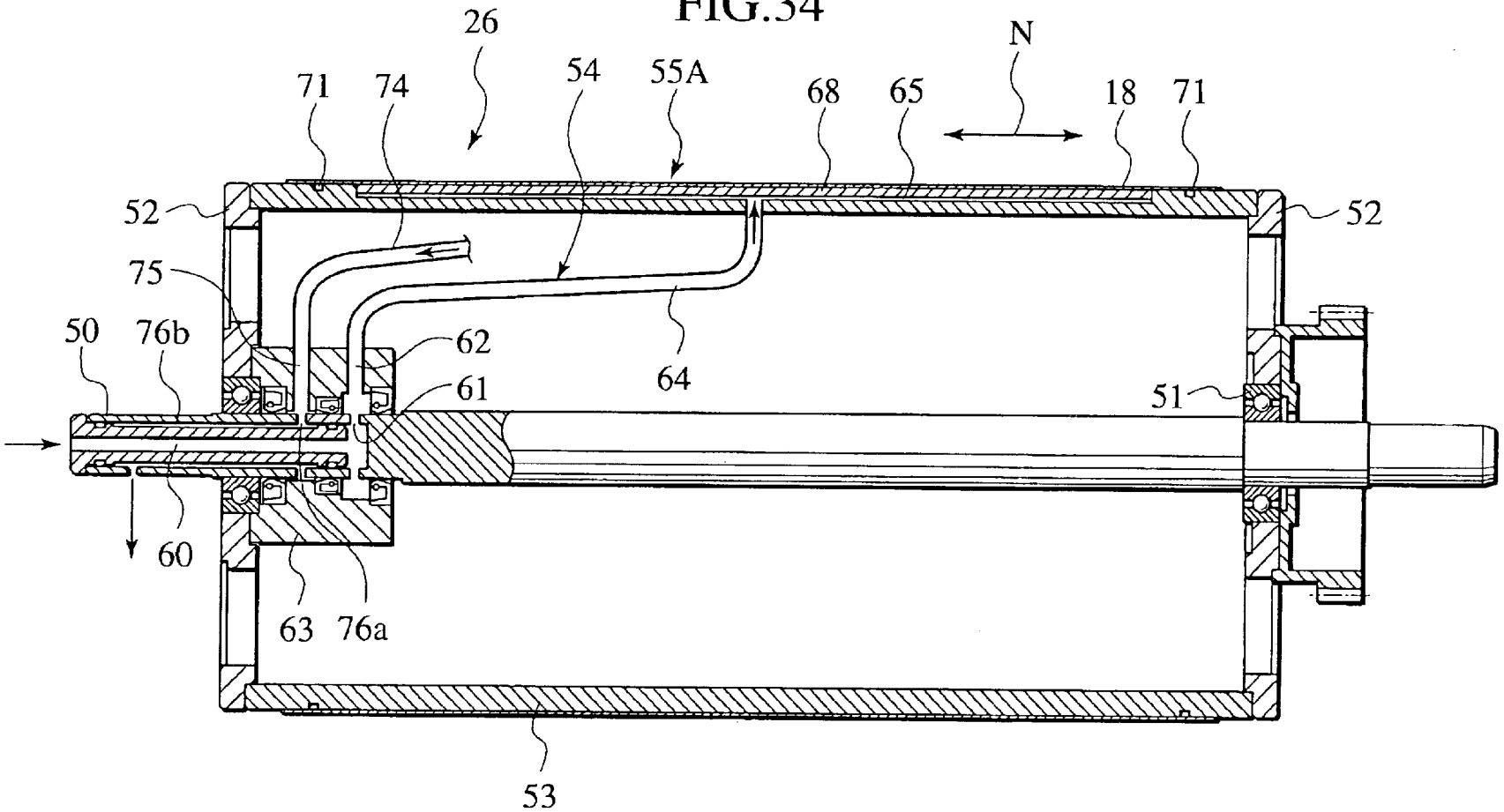
FIG. 34 shows the fourth embodiment of the present invention and is a cross-sectional view taken along the line 34—34 in FIG. 33.
Figure 35:
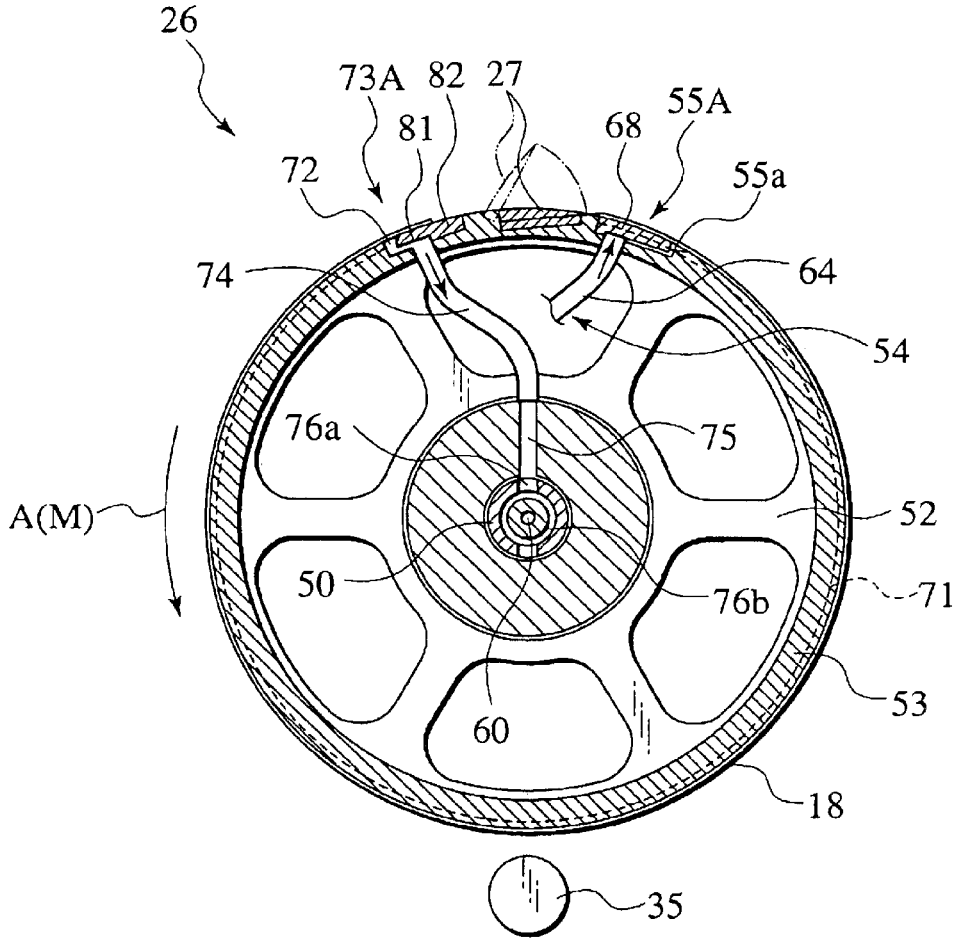
FIG. 35 shows the fourth embodiment of the present invention and is a cross-sectional view taken along the line 35—35 in FIG. 33.

FIGS. 33 to 35 show a fourth embodiment of the present invention. FIG. 33 is a perspective view of the drum, FIG.

34 is a cross-sectional view taken along the line 34—34 in FIG. 33, and FIG. 35 is a cross-sectional view taken along the line 35—35 in FIG. 33.

As shown in FIGS. 33 to 35, in the fourth embodiment, the only difference from the third embodiment is the construction of the ink leakage preventing grooves 71 and 72 of the ink recovery device 73A. Similarly to the second modification of the second embodiment (refer to FIG. 22), the ink leakage preventing groove 72 of the fourth embodiment is formed at the printing position downstream of the maximum printing area Sand continuously formed along the printing perpendicular direction N. At the same time, the leakage grooves 71 of the fourth embodiment are formed at the positions on the right and left as well as outside of the maximum printing area S in the printing perpendicular direction N and continuously formed along the printing direction M. The rest of the construction is the same as that of the third embodiment. Therefore, the same constituents are designated by the same reference numerals, and detailed description thereof is omitted.

In the fourth embodiment, similarly to the first embodiment, the ink 56 does not deteriorate even when the printing is not carried out for a long time. Further, the small and light-weighted drum 26 can be realized. Furthermore, similarly to the third embodiment, the excessive ink 56 can be removed from the outer peripheral wall 53 of the drum 26, and recycling of the ink 56 can be realized.

Moreover, since the ink 56 stored in the ink leakage preventing grooves 71 and 72 is recovered, the ink 56 can be certainly prevented from overflowing from the ink leakage preventing grooves 71 and 72. In addition, in comparison with the case of the third embodiment, the excessive ink 56 leaking from the sides of the outer peripheral wall 53 can be recovered, and the leakage from the side thereof can be more certainly prevented. As a matter of course, in the fourth embodiment, the ink recovery device 73A may have the same construction of those in FIGS. 31 and 32.

Figure 36A:
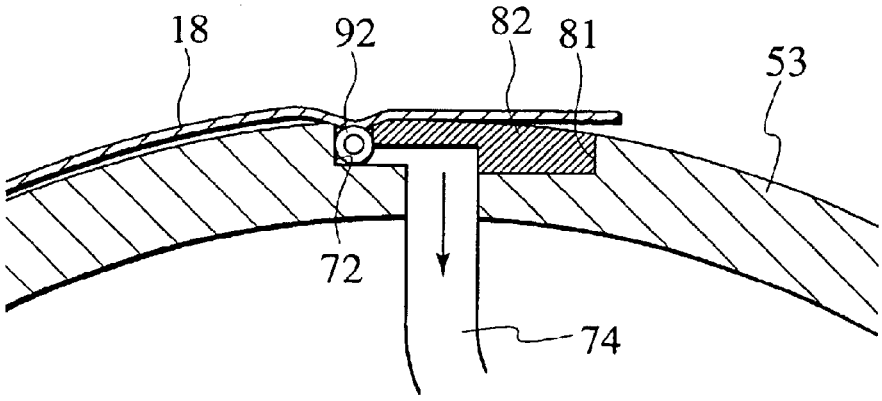
FIGS. 36A to 36C show a first modification of the ink leakage preventing groove of the third and fourth embodiments.
Figure 36B:
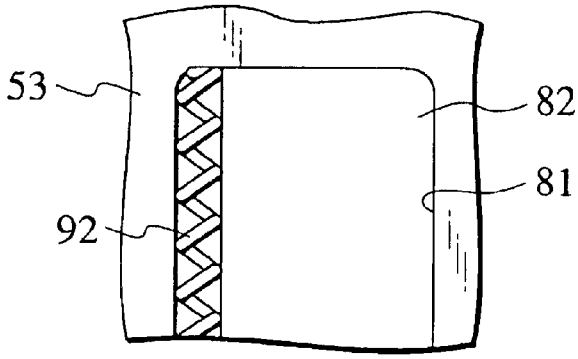
Figure 36C:
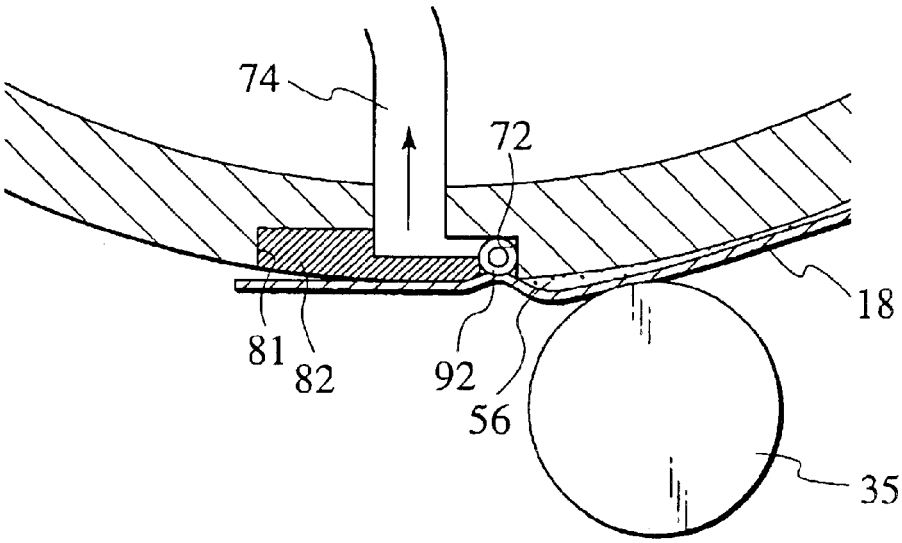

FIGS. 36A to 36C show a first modification of the ink leakage preventing groove of the third and fourth embodiments. FIG. 36A is a cross-sectional view of the vicinity of the ink leakage preventing groove, FIG. 36B is a plan view partially showing the vicinity of the ink leakage preventing groove, and FIG. 36C is a cross-sectional view explaining behavior of the stencil sheet.

As shown in FIGS. 36A to 36C, the first modification is different from the ink leakage preventing groove 72 of the third and fourth embodiments in that a spiral ring member 92, serving as a depression preventing member, is fixed inside the ink leakage preventing groove 72. Concretely, the spiral ring member 92 is secured to the ink leakage preventing groove 72 by forcing the spiral ring member 92 into the ink leakage preventing groove 72 by means of its elasticity. The top surface height of the spiral ring member 92 is set to be the same as or slightly lower than the surface of the outer peripheral wall 53. Since the rest of the construction is the same, the same constituents are designated by the same reference numerals, and the detailed description thereof is omitted.

In the first modification, as shown in FIG. 36A, the stencil sheet 18 is not depressed into the link leakage preventing groove 72 by the suction power of the ink recovery device. Accordingly, a reduction in recovery efficiency owing to blockage of the ink recovery passage of the ink leakage preventing groove 72 by the stencil sheet 18 can be prevented. Further, as shown in FIG. 36C, the stencil sheet 18 does not stick to the edge of the ink leakage preventing groove 72 and thus does not seal the ink at the sticking position. Therefore, the ink smoothly flows into the ink leakage preventing groove 72 by being squeezed by the pressure roller 35, and thereby the ink does not leak from the end of the outer peripheral wall 53. Furthermore, since the pressure roller 35 is not depressed into the ink leakage preventing groove 72 when passing over the ink leakage preventing groove 72, occurrences of depression noise and vibration of the pressure roller 35 can be prevented.

Figure 37A:
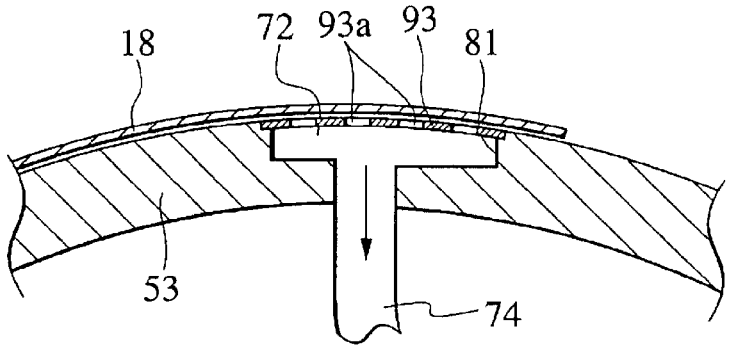
FIGS. 37A and 37B show a second modification of the ink leakage preventing groove of the third and fourth embodiments.
Figure 37B:
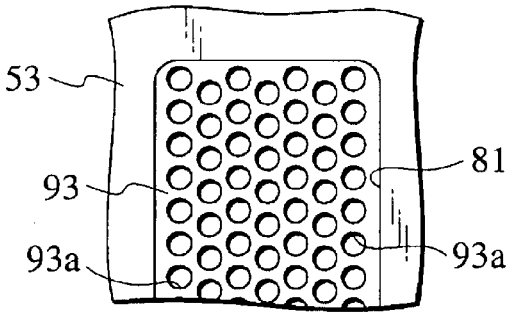

FIGS. 37A and 37B show a second modification of the ink leakage preventing groove of the third and fourth embodiments. FIG. 37A is a cross-sectional view of the vicinity of the ink leakage preventing groove, and FIG. 37B is a plan view partially showing the vicinity of the ink leakage preventing groove.

As shown in FIGS. 37A and 37B, the second modification is different from the ink leakage preventing groove 72 of the third and fourth embodiments in that a punching metal 93, serving as the depression preventing member, is placed so as to cover the surface of the ink leakage preventing groove 72. The punching metal 93 has multiple holes 93*a* through which the ink can freely flow into the ink leakage preventing groove 72 from outside. The surface of the punching metal 93 is formed to have an ark shape and to be flush with the outer peripheral wall 53 of the drum. Since the rest of the constitution is the same as the third and fourth embodiments, the same constituents are designated by the same reference numerals, and detailed description thereof is omitted.

In the second modification, as shown in FIG. 37A, the stencil sheet 18 is not depressed into the ink leakage preventing groove 72 by the suction power of the ink recovery device. Accordingly, a reduction in recovery efficiency owing to blockage of the ink recovery passage of the ink leakage preventing groove 72 by the stencil sheet 18 can be prevented. Further, the stencil sheet 18 does not stick to the edge of the ink leakage preventing groove 72 and thus does not seal the ink at the sticking position. Therefore, the ink smoothly flows into the ink leakage preventing groove 72 by being squeezed by the pressure roller, and thereby the ink does not leak from the end of the outer peripheral wall 53. Furthermore, since the pressure roller is not depressed into the ink leakage preventing groove 72 when passing over the ink leakage preventing groove 72, depression noise and vibration of the pressure roller 35 can be prevented.

Figure 38:
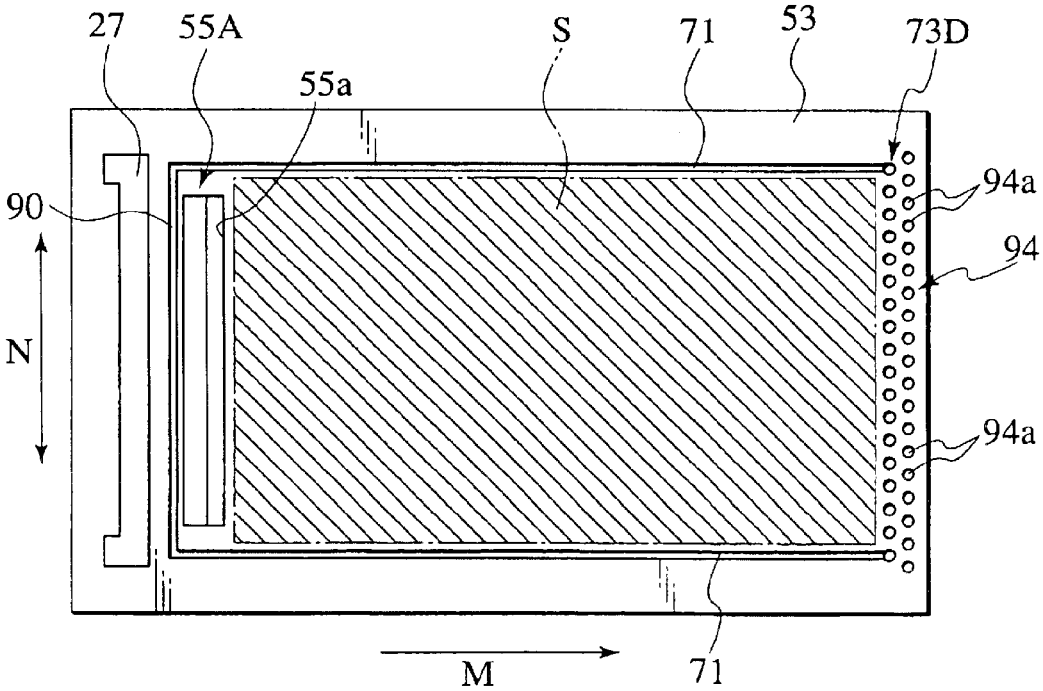
FIG. 38 shows a fifth embodiment of the present invention and is a schematic view of an exploded outer peripheral wall of a drum.

FIG. 38 shows a fifth embodiment of the present invention and is a schematic view of the exploded outer peripheral wall of the drum. As shown in FIG. 38, in the fifth embodiment, an ink recovery device 73D has an ink recovery groove 94 at a printing position downstream of the maximum printing area S of the outer peripheral wall 53 of the drum, and is constructed so as to recover the ink stored in the ink leakage preventing groove 94. Specifically, while the ink flown outside of the maximum printing area S is recovered using the ink leakage preventing groove 72 in the third and fourth embodiments, the ink flown outside and downstream of the maximum printing area S is recovered using the ink recovery groove 94 in the fifth embodiment.

Compared with the construction of the third modification of the second embodiment, the fifth embodiment has a construction in which the ink recovery groove 94 is provided instead of the ink leakage preventing groove 72 at the same position. The ink recovery groove 94 includes multiple opening portions 94*a* formed in two rows in the printing direction M and at an interval in the printing perpendicular direction N.

For the construction apart from the ink recovery groove 94, any one of the aforementioned ink recovery device 73A to 73C is employed. The same constituents as those in the fourth embodiment in FIG. 38 are designated by the same reference numerals for clarification.

In the fifth embodiment, similarly to the fourth embodiment, the ink flown out downstream in the printing direction by being squeezed by the pressure roller is removed from the outer peripheral wall 53 of the drum, and recycling of the ink can be realized.

Further, in the fifth embodiment, the stencil sheet 18 is not depressed into the link recovery groove 94 by the suction power of the ink recovery device 73D. Accordingly, a reduction in recovery efficiency owing to blockage of the ink recovery passage of the ink recovery groove 94 by the stencil sheet 18 can be prevented. Further, the stencil sheet 18 does not stick to the edge of the ink recovery groove 94 and thus does not seal the ink at the sticking position. Therefore, the ink smoothly flows into the ink recovery groove 94 by being squeezed by the pressure roller, and thereby the ink does not leak from the end of the outer peripheral wall 53. Furthermore, since the pressure roller is not depressed into the ink recovery groove 94 when passing over the ink recovery groove 94, depression noise and vibration of the pressure roller 35 can be prevented.

Figure 39:
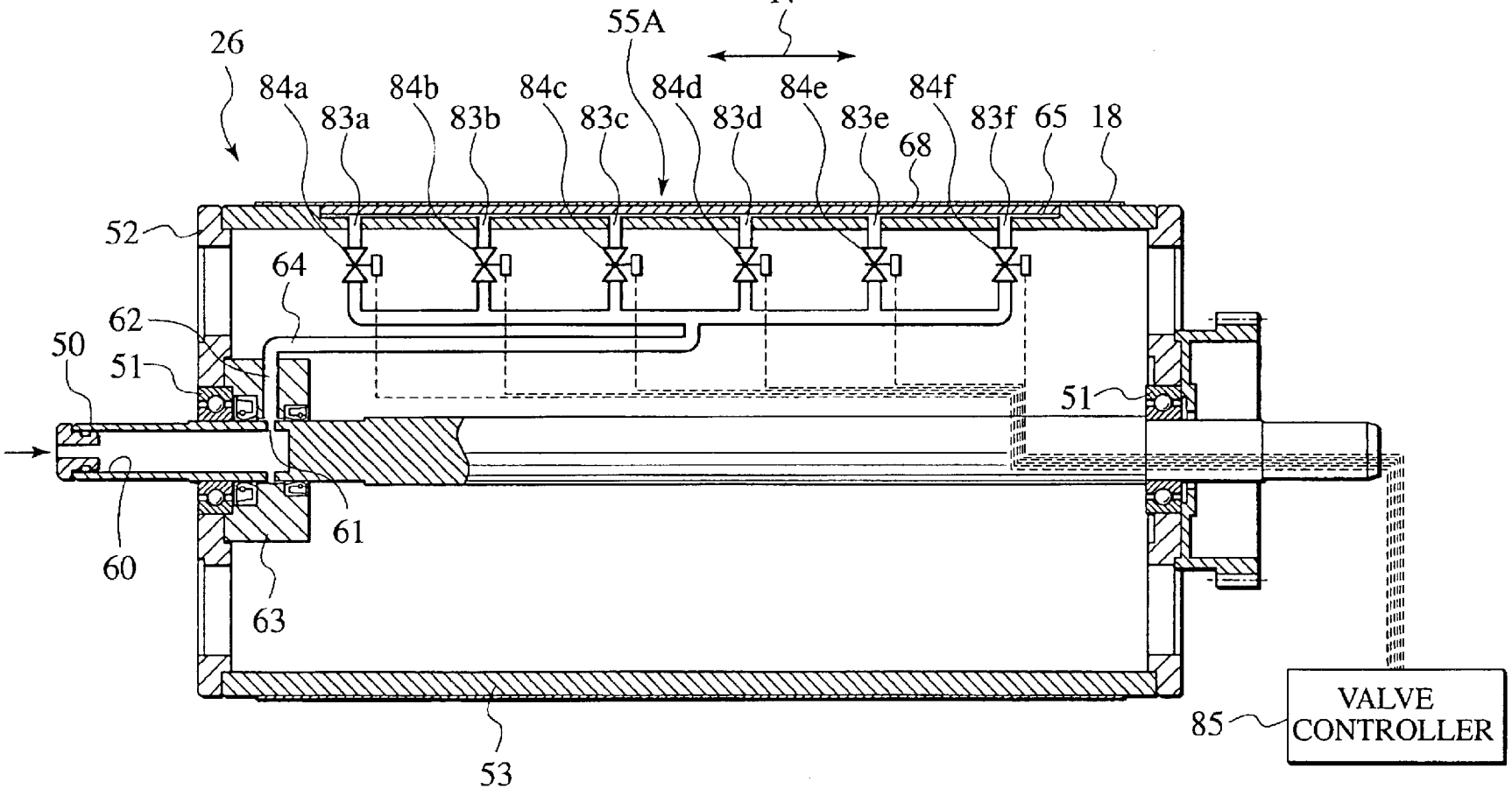
FIG. 39 shows a sixth embodiment of the present invention and is a cross-sectional view of a drum.
Figure 40:
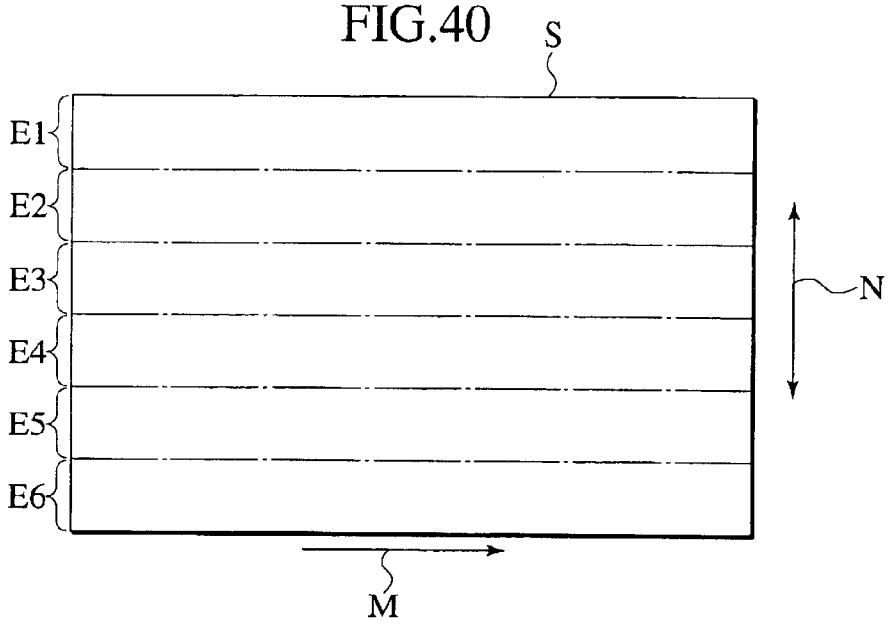
FIG. 40 shows the sixth embodiment of the present invention and an explanatory view showing a maximum printing area divided into six areas.
Figure 41:
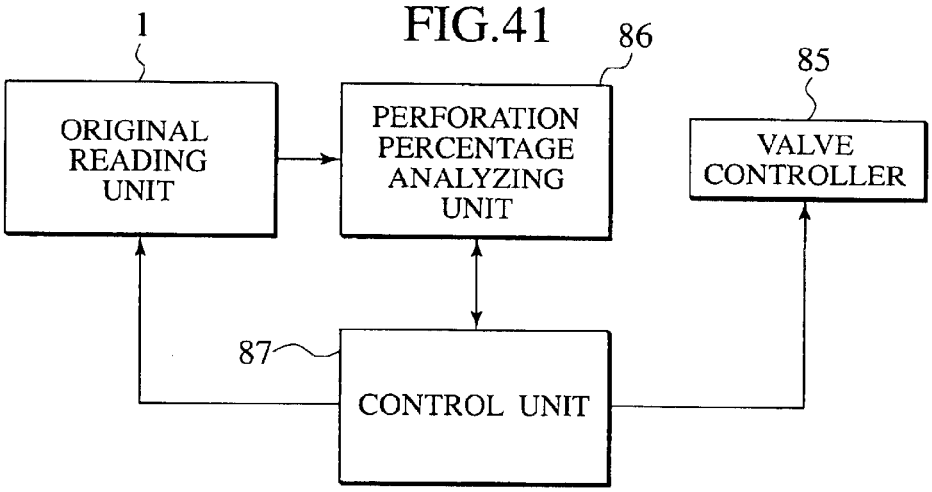
FIG. 41 shows the sixth embodiment of the present invention and is a control block diagram.

FIGS. 39 to 41 show a sixth embodiment of the present invention. FIG. 39 is a cross-sectional view of the drum, FIG. 40 is an explanatory view showing the maximum printing area divided into six areas, and FIG. 41 is a control block diagram.

As shown in FIG. 39, in the sixth embodiment, the ink supply to the ink supply unit 55A is carried out through ink supply passages 83*a* to 83*f* arranged at an equal interval in the printing perpendicular direction N. Control valves 84*a* to 84*f*, each of which controls an ink flow volume, are attached to these ink supply passages 83*a* to 83*f*, respectively. When the maximum printing area of the outer peripheral wall 53 is divided into six areas in the printing perpendicular direction N, six of these ink supply passages 83*a* to 83*f* and the control valves 84*a* to 84*f* are arranged at the upstream positions of the divided areas, and each of them are almost in charge of ink supply for each of the divided areas E1 to E6 (shown in FIG. 40). Specifically, six of the control valves 84*a* to 84*f* construct ink volume adjusting means which controls ink supply from the ink supply unit 55A in the printing perpendicular direction N. Opening/closure of the control valves 84*a* to 84*f* are respectively controlled by a valve controller 85.

Meanwhile, as shown in FIG. 41, the sixth embodiment has a perforation percentage analyzing unit 86 which detects a perforation percentage in each of the divided areas E1 to E6 based on the image data form the original reading unit 1. A control unit 87 outputs an instruction to the valve controller 85 for the opening/closure state in accordance with the perforation percentage. To be specific, the control unit 87 sends the instruction to open the valve more widely with a high perforation percentage, and to open the valve less widely with a low perforation percentage. Note that the rest of the construction is the same as that of the first embodiment. Therefore, the same constituents are designated by the same reference numerals, and detailed description thereof is omitted.

In the sixth embodiment, similarly to the first embodiment, the ink 56 does not deteriorate even when printing is not carried out for a long time. Further, the small and light-weighted drum 26 can be realized.

Furthermore, the sixth embodiment has the plurality of control valves 84*a* to 84*f* which can control ink supply volume from the ink supply unit 55A in the printing perpendicular direction N, and each of the control valves 84*a* to 84*f* are controlled in accordance with the perforation percentage of the stencil sheet 18. Therefore, the ink supply volume is increased for an area with a high perforation percentage and decreased for an area with a low perforation percentage, thus supplying only a required volume of ink 56 to a required area. Thus, excessive ink supply can be prevented as soon as possible. Specifically, efficient ink diffusion can be carried out, and probability of ink leakage can be reduced.

Figure 42:
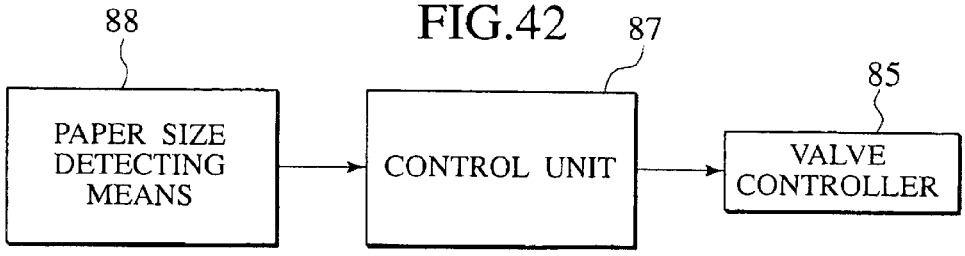
FIG. 42 is the control block diagram showing a modification of the sixth embodiment.

FIG. 42 is a control block diagram showing a modification of the sixth embodiment.

In this modification, paper size detecting means 88 is provided, which detects a paper size (paper width) of the print paper set on the paper feed tray. The control unit 87 outputs an instruction to the valve controller 85 for the opening/closure state in accordance with a detection result (paper size) from the paper size detecting means 88. To be specific, the control unit 87 sends the instruction to open the control valve in the divided area where the print paper is present and to close the control valve in the divided area where the print paper is not present. Since the rest of the construction is the same as the sixth embodiment, detailed description thereof is omitted.

In the modification of the sixth embodiment, the plurality of control valves are provided, which can control the ink supply volume from the ink supply unit in the printing perpendicular direction, and each of the control valves are controlled in accordance with a size of the print paper to be fed. Therefore, the ink 56 is supplied to the area where the print paper is present and is not supplied to the area where the print paper is not present. Thus, the ink 56 can be supplied only to required areas, and the excessive ink supply can be prevented as soon as possible. Specifically, efficient ink diffusion can be carried out, and probability of ink leakage can be reduced. Incidentally, the control in accordance with a perforation percentage of the sixth embodiment and the control in accordance with a sheet size of the modification of the sixth embodiment can be performed together.

Figure 43:
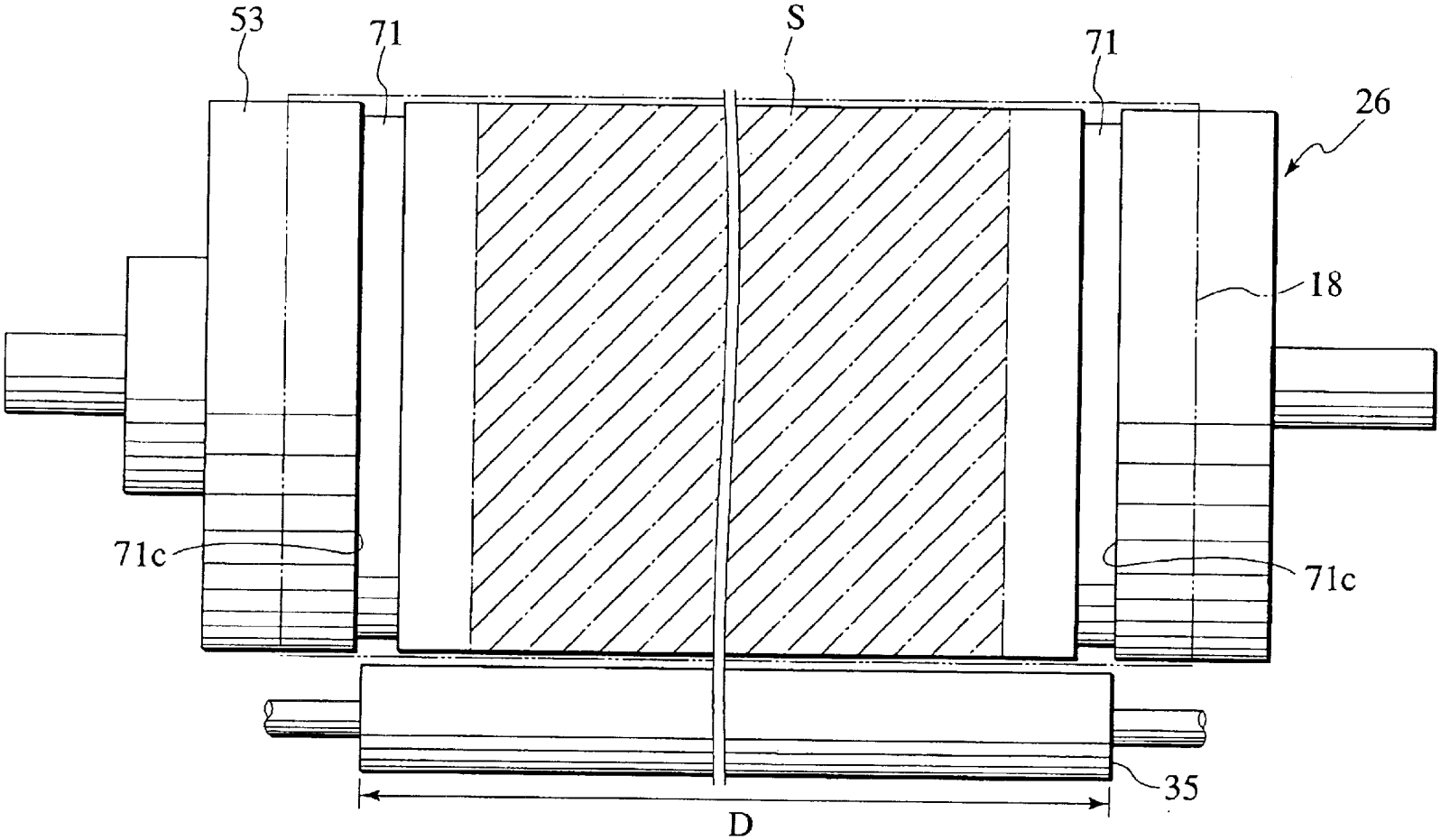
FIG. 43 shows a seventh embodiment of the present invention and is a front view of a drum and a pressure roller.

FIG. 43 shows a seventh embodiment of the present invention and is a front view of the drum and the pressure roller. As shown in FIG. 43, in the seventh embodiment, a width D of the pressure roller 35 is set between the ink leakage preventing grooves 71 and 71, respectively provided at the positions on the right and left sides as well as outside of the maximum printing area S in the printing perpendicular direction N, so that the pressure roller 35 presses the inner sides of the respective outer edges of these two ink leakage preventing grooves 71 and 71. Specifically, the width D of the pressure roller 35 is set to a dimension between a width of the maximum printing area S and a width between the outer edges of the ink leakage preventing grooves 71 and 71 on the light and left sides.

In the seventh embodiment, since the pressure roller 35 does not press the ink leakage preventing grooves 71 and 71 over their whole width, the ink in the ink leakage preventing grooves 71 and 71 are prevented from overflowing outside the ink leakage preventing grooves 71 and 71 due to pressing force of the pressure roller 35. In the case where the ink recovery device is constructed to recover the ink in the ink leakage preventing grooves 71 and 71 by suction power, the pressure roller 35 does not press outside of the ink leakage preventing grooves 71 and 71. Thus, the ink leaking outside of the ink leakage preventing grooves 71 and 71 are not pressed by the pressure roller 35, and thereby the leaking ink is more likely to be recovered into the ink leakage preventing grooves 71 and 71 again by the suction of the ink recovery device.

Figure 44:
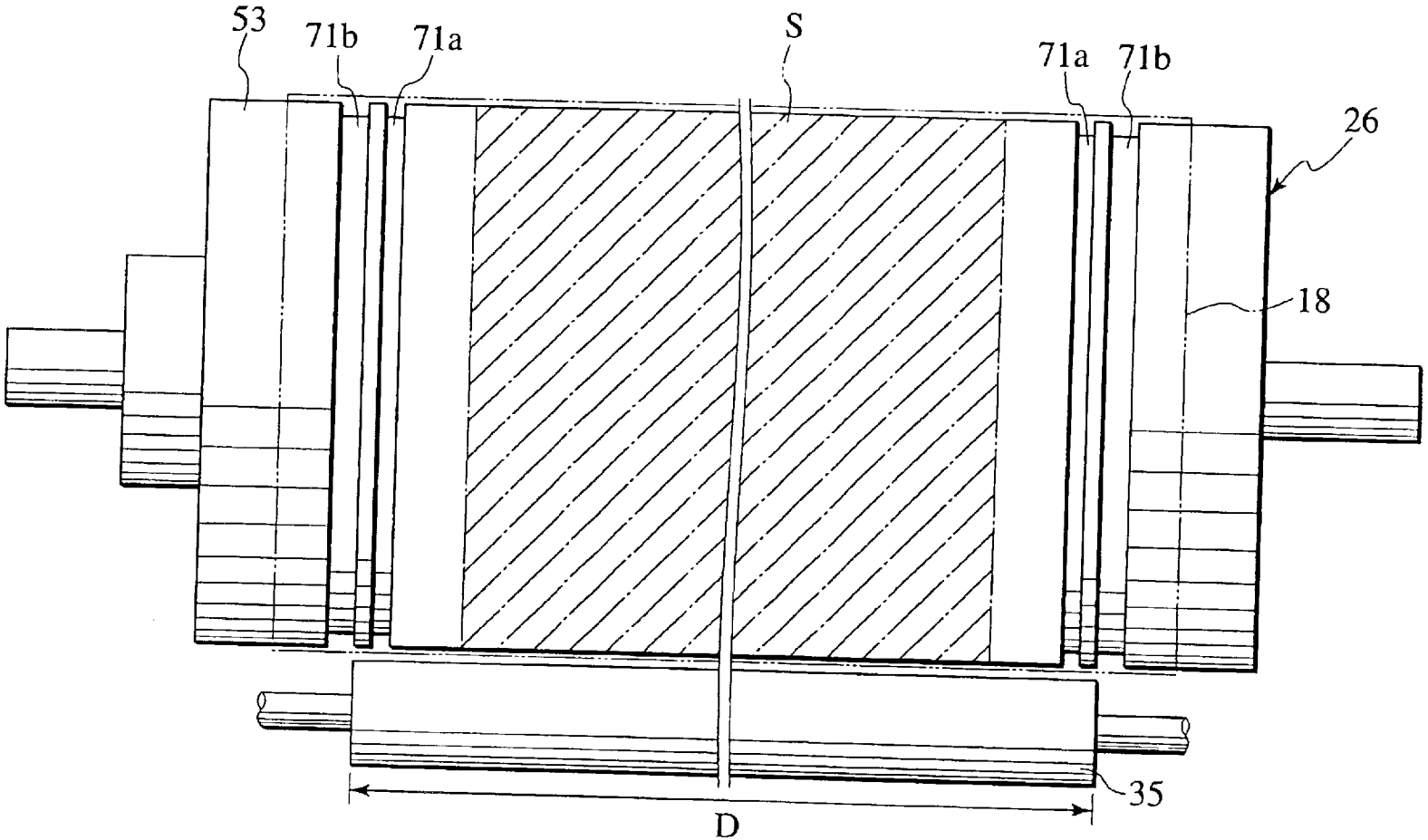
FIG. 44 shows a modification of the seventh embodiment of the present invention and is a front view of the drum and the pressure roller.

FIG. 44 shows a modification of the seventh embodiment and is a front view of the drum and the pressure roller. As shown in FIG. 44, in the modification of the seventh embodiment, the ink leakage preventing grooves 71*a* and 71*b* provided on the right and left sides as well as outside of the maximum printing area S are doubly formed. The width D of the pressure roller 35 is set so that each of the right and left edges of the pressure roller 35 presses the area between the ink leakage preventing groove 71*a* on the inner peripheral side and the ink leakage preventing groove 71*b* on the outer peripheral side at each of the right and left positions.

With this construction, the pressure roller 35 moves while surely squeezing an area between the ink leakage preventing grooves 71*a* and 71*a* on the inner peripheral sides. Therefore, the ink is uniformly diffused in the area between the ink leakage preventing grooves 71*a* and 71*a* on the right and left sides, and nonuniform printing density can be further prevented. Meanwhile, since the pressure roller 35 does not press the ink leakage preventing grooves 71*b* and 71*b* on the outer peripheral sides, the ink leaking outside of the ink leakage preventing grooves 71*b* and 71*b* are not pressed by the pressure roller 35. Therefore, the leaking ink is more likely to be recovered into the ink leakage preventing grooves 71*b* and 71*b* by the suction of the ink recovery device.

What is claimed is:

1. A stencil printing machine, comprising:

a drum which is rotatable and has a outer peripheral wall formed by an ink impermeable member and in which a stencil sheet is mounted on a surface of the outer peripheral wall;

an ink supply device which has an ink supply unit at a printing position upstream of a maximum printing area of the outer peripheral wall of the drum and supplies ink from an interior of said drum to the surface of the outer peripheral wall from the ink supply unit; and a pressure roller which presses a fed print medium onto the outer peripheral wall.

2. The stencil printing machine according to claim 1, wherein at least one ink leakage preventing groove is provided on the outer peripheral wall at a position outside of the maximum printing area and covered with the stencil sheet.

3. The stencil printing machine according to claim 2, wherein the ink leakage preventing grooves are provided on right and left outsides of the maximum printing area in a printing perpendicular direction.

4. The stencil printing machine according to claim 3, wherein a width of the pressure roller is set between the ink leakage preventing grooves, respectively provided at positions on the right and left sides as well as outside of the maximum printing area in the printing perpendicular direction, so that the pressure roller presses inner sides of respective outer edges of both of the ink leakage preventing grooves.

5. The stencil printing machine according to claim 2, wherein the ink leakage prevention groove is provided at a printing position downstream of the maximum printing area.

6. The stencil printing machine according to claim 2, wherein the ink leakage prevention groove is provided on right and left outsides of the maximum printing area in a printing perpendicular direction and on a printing position downstream of the maximum printing area.

7. The stencil printing machine according to claim 2, wherein the ink leakage preventing groove is provided at a printing position further upstream of the ink supply unit upstream of the maximum printing area.

8. The stencil printing machine according to claim 2, wherein a plurality of the ink leakage preventing grooves are provided.

9. The stencil printing machine according to claim 1, further comprising an ink recovery device which recovers ink leaking outside the maximum printing area of the outer peripheral wall.

10. The stencil printing machine according to claim 9, wherein the ink recovery device has an ink recovery groove at a printing position downstream of the maximum printing area of the outer peripheral wall and recovers the ink stored in the ink recovery groove.

11. The stencil printing machine according to claim 10, wherein the ink recovery device recovers the ink stored in an ink leakage preventing groove by utilizing the ink leakage preventing groove as the ink recovery groove.

12. The stencil printing machine according to claim 10, wherein a depression preventing member through which the ink can flow is placed in the ink recovery groove.

13. The stencil printing machine according to claim 12, wherein the depression preventing member is flush with a peripheral surface of the outer peripheral wall of the drum.

14. The stencil printing machine according to claim 9, wherein the ink supply device and the ink recovery device are always driven in a printing mode.

15. The stencil printing machine according to claim 1, wherein the ink supply unit is provided along a printing perpendicular direction on the outer peripheral wall and supplies ink almost uniformly in the printing perpendicular direction.

16. The stencil printing machine according to claim 15, wherein the ink supply unit supplies the ink from a plurality of ink supply ports provided at an interval in the printing perpendicular direction on the outer peripheral wall.

17. The stencil printing machine according to claim 15, further comprising ink volume adjusting means which controls an ink supply volume from the ink supply unit in the printing perpendicular direction, wherein the ink volume adjusting means is controlled in accordance with a perforation percentage of the stencil sheet.

18. The stencil printing machine according to claim 15, further comprising ink volume adjusting means which controls an ink supply volume from the ink supply unit in the printing perpendicular direction, wherein the ink volume adjusting means is controlled in accordance with a size of the print medium to be fed.

19. The stencil printing machine according to claim 1, wherein the ink supply unit is closed up by the stencil sheet so as to supply ink between the surface of the outer peripheral wall of the drum and the stencil sheet without exposing ink to the atmosphere.

20. The stencil printing machine according to claim 1, wherein the ink supply device includes a conduit which supplies ink between the surface of the outer peripheral wall of the drum and the stencil sheet without exposing ink to the atmosphere.

* * * * *